US010861394B2

(12) United States Patent
Jang

(10) Patent No.: US 10,861,394 B2
(45) Date of Patent: Dec. 8, 2020

(54) GATE DRIVING CIRCUIT AND LIGHT EMITTING DISPLAY APPARATUS INCLUDING THE SAME

(71) Applicant: LG Display Co., Ltd., Seoul (KR)

(72) Inventor: YongHo Jang, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 61 days.

(21) Appl. No.: 16/195,220

(22) Filed: Nov. 19, 2018

(65) Prior Publication Data

US 2019/0164498 A1 May 30, 2019

(30) Foreign Application Priority Data

Nov. 30, 2017 (KR) ..... 10-2017-0162545

(51) Int. Cl.

*G09G 3/3266* (2016.01)
*G09G 3/32* (2016.01)
*G09G 3/36* (2006.01)

(52) U.S. Cl.

CPC ..... *G09G 3/3266* (2013.01); *G09G 3/32* (2013.01); *G09G 3/3677* (2013.01); *G09G 2300/0408* (2013.01); *G09G 2300/0861* (2013.01); *G09G 2310/0286* (2013.01); *G09G 2310/06* (2013.01); *G09G 2310/061* (2013.01); *G09G 2310/08* (2013.01); *G09G 2320/0214* (2013.01)

(58) Field of Classification Search

None

See application file for complete search history.

(56) References Cited

U.S. PATENT DOCUMENTS

2006/0156121 A1* 7/2006 Chung ..... G09G 3/3233 714/726
2012/0194489 A1* 8/2012 Iwamoto ..... G09G 3/3685 345/204
2018/0308444 A1* 10/2018 Sueki ..... G11C 19/28
2020/0126502 A1* 4/2020 Takeuchi ..... G09G 3/36

FOREIGN PATENT DOCUMENTS

KR 10-2017-0038304 A 4/2017

* cited by examiner

*Primary Examiner* — Benjamin C Lee
*Assistant Examiner* — Emily J Frank
(74) *Attorney, Agent, or Firm* — Fenwick & West LLP

(57) ABSTRACT

A gate driving circuit and a light emitting display apparatus including the same has a simplified circuit that outputs a stable emission control signal. The gate driving circuit includes an emission control shift register including a plurality of emission control stages that each respectively supply an emission control signal to one of a plurality of emission control lines, each emission control line connected to at least one pixel of a plurality of pixels in a light emitting display panel. For an emission control line, when at least one of first input signal and the second input signal has a first voltage level, an emission control stage outputs the emission control signal having a gate-off voltage level, and when both of the first input signal and the second input signal have a second voltage level, the corresponding emission control signal has a gate-on voltage level.

24 Claims, 16 Drawing Sheets

GATE DRIVING CIRCUIT AND LIGHT EMITTING DISPLAY APPARATUS INCLUDING THE SAME

CROSS-REFERENCE TO RELATED APPLICATIONS

This application claims the benefit of the Republic of Korea Patent Application No. 10-2017-0162545 filed on Nov. 30, 2017, which is hereby incorporated by reference in its entirety.

BACKGROUND

Field of the Disclosure

The present disclosure relates to a gate driving circuit and a light emitting display apparatus including the same.

Discussion of the Related Art

In the field of display apparatuses, liquid crystal display (LCD) apparatuses which are light and are low in power consumption are being widely used up to date, but need a separate light source such as a backlight. Unlike the LCD apparatuses, light emitting display apparatuses display an image by using a self-emitting device. In comparison with the LCD apparatuses, the light emitting display apparatuses have a fast response time, low power consumption, and a good viewing angle, and thus, are attracting much attention as next-generation display apparatuses.

General light emitting display apparatuses include a pixel circuit which is provided in each of a plurality of pixels. The pixel circuit applies a data voltage to a gate electrode of a driving transistor by using a plurality of switching transistors which are turned on by a scan signal and an emission control signal, charges a storage capacitor with the data voltage applied to the driving transistor, and turns on the driving transistor with the data voltage charged into the storage capacitor according to the emission control signal to supply a light emitting device with a data current corresponding to the data voltage, thereby allowing the light emitting device to emit light.

In the general light emitting display apparatuses, a gate driving circuit configured by a combination of thin film transistors (TFTs) provided in a non-display area (or a bezel area) of a light emitting display panel supplies the scan signal and the emission control signal to the light emitting display panel. In this case, since an output timing of the scan signal differs from that of emission control signal, the gate driving circuit outputs the scan signal and the emission control signal by using a plurality of shift registers which independently operate.

Therefore, in the gate driving circuit of each of the general light emitting display apparatuses, a bezel width of each of the light emitting display apparatuses increases due to the large number of TFTs configuring the shift registers for individually outputting the scan signal and the emission control signal. Also, each of the shift registers includes a plurality of stages each including a plurality of N-type TFTs.

Due to a characteristic where a gate voltage is lower than a low level voltage applied to a source terminal, the N-type TFTs are logically turned off by a gate-off voltage which is applied as the gate voltage, but since a gate-source voltage is higher than 0 V, a leakage current occurs in the N-type TFTs. When a threshold voltage of a TFT is shifted (or changed) from a positive voltage to a negative voltage due to the leakage current, the leakage current increases more, and for this reason, a circuit cannot normally operate, whereby a normal emission control signal is not output. Particularly, when each of the shift registers is configured with an oxide TFT, a threshold voltage of the oxide TFT is shifted to a negative voltage due to light and/or a high temperature, and due to this, a control node voltage is reduced by a leakage current of a TFT connected between a control node and a low level voltage source of each of the plurality of stages. For this reason, a circuit cannot normally operate, and due to this, the normal emission control signal is not output.

SUMMARY

Accordingly, the present disclosure is directed to provide a gate driving circuit and a light emitting display apparatus including the same that substantially obviate one or more problems due to limitations and disadvantages of the related art.

An aspect of the present disclosure is directed to provide a gate driving circuit and a light emitting display apparatus including the same, in which a configuration of a circuit is simplified, and an emission control signal is stably output.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

In accordance with an aspect of one embodiment of the present disclosure, the above and other objects can be accomplished by a gate driving circuit including an emission control shift register connected to a scan control shift register and receiving a first input signal and a second input signal from the scan control shift register, the emission control shift register including a plurality of emission control stages that each respectively supply an emission control signal to one of a plurality of emission control lines, each emission control line connected to at least one pixel of a plurality of pixels in a light emitting display panel. When at least one of the first input signal and the second input signal has a first voltage level, an emission control stage from the plurality of emission control stages that received the first input signal and the second input signal outputs the emission control signal having a gate-off voltage level to an emission control line connected to the emission control stage, the gate-off voltage level turning off a transistor included in a pixel connected to the emission control line. When both of the first input signal and the second input signal have a second voltage level that is less than the first voltage level, the emission control stage outputs the emission control signal having a gate-on voltage level to turn on the transistor included in the pixel connected to the emission control line.

In accordance with an aspect of one embodiment of the present disclosure, the above and other objects can be accomplished by a light emitting display apparatus including a light emitting display panel including a plurality of pixels respectively provided in a plurality of pixel areas defined by a plurality of gate lines, a plurality of emission control lines, and a plurality of data lines, a data driving circuit supplying a data signal to each of the plurality of data lines, and a gate driver provided in the light emitting display panel to supply a scan signal to each of the plurality of gate lines and to supply an emission control signal to each of the plurality of emission control lines.

In some embodiments, the gate driver includes an emission control shift register connected to a scan control shift register and receiving a first input signal and a second input signal from the scan control shift register, the emission control shift register including a plurality of emission control stages that each respectively supply an emission control signal to one of the plurality of emission control lines, each emission control line connected to at least one pixel of the plurality of pixels in the light emitting display panel. When at least one of the first input signal and the second input signal has a first voltage level, an emission control stage from the plurality of emission control stages that received the first input signal and the second input signal outputs the emission control signal having a gate-off voltage level to an emission control line connected to the emission control stage, the gate-off voltage level turning off a transistor included in a pixel connected to the emission control line. When both of the first input signal and the second input signal have a second voltage level that is less than the first voltage level, the emission control stage outputs the emission control signal having a gate-on voltage level to turn on the transistor included in the pixel connected to the emission control line.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE DISCLOSURE

Figure 1:
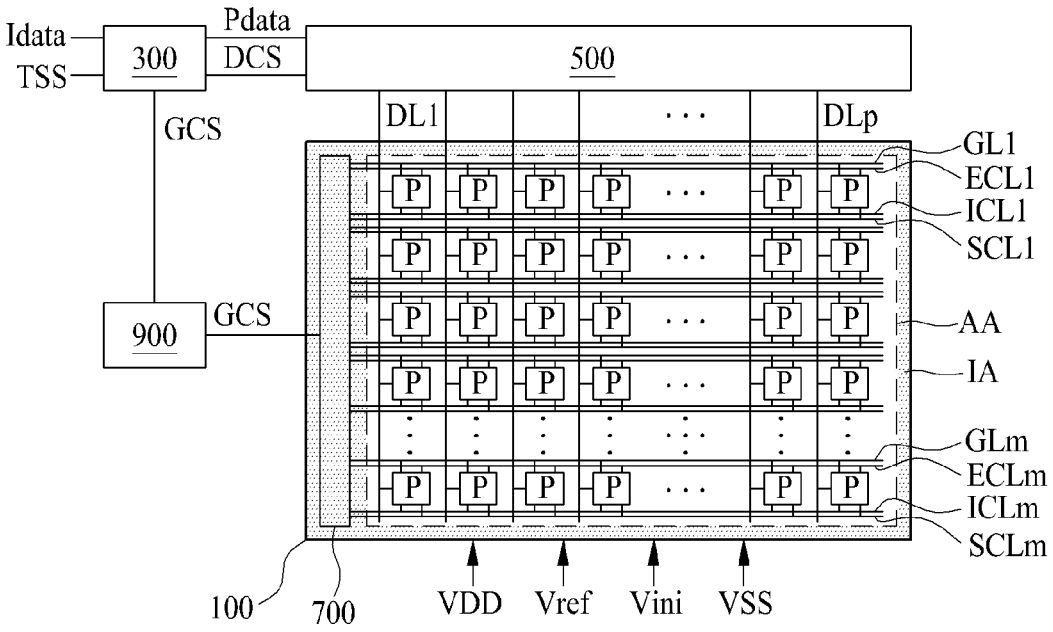
FIG. 1 is a diagram schematically illustrating a light emitting display apparatus according to an embodiment of the present disclosure.

Reference will now be made in detail to the exemplary embodiments of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Furthermore, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known technology is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~' and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of a gate driving circuit and a light emitting display apparatus including the same according to the present disclosure will be described in detail with reference to the accompanying drawings. In adding reference numerals to elements of each of the drawings, although the same elements are illustrated in other drawings, like reference numerals may refer to like elements. In the following description, when the detailed description of the relevant known function or configuration is determined to unnecessarily obscure the important point of the present disclosure, the detailed description will be omitted.

FIG. 1 is a diagram schematically illustrating a light emitting display apparatus according to an embodiment of the present disclosure.

Referring to FIG. 1, the light emitting display apparatus according to an embodiment of the present disclosure may include a light emitting display panel 100, a timing controller 300, a data driving circuit 500, and a gate driving circuit (or a gate driver) 700.

The light emitting display panel may include a display area AA defined on a substrate and a non-display area NA surrounding the display area AA.

The display area AA may include a plurality of pixels P respectively provided in a plurality of pixel areas which are defined by first to $m^{th}$ (where m is a natural number equal to or more than two) gate lines GL1 to GLm, first to $m^{th}$ emission control lines ECL1 to ECLm, and a plurality of data lines DL1 to DLp (where p is a natural number equal to or more than two). Also, the display area AA may further include first to $m^{th}$ initialization control lines ICL1 to ICLm and first to $m^{th}$ sampling control lines SCL1 to SCLm. Also, the display area AA may further include a plurality of pixel driving voltage lines supplied with a pixel driving voltage VDD, a plurality of initialization voltage lines supplied with an initialization voltage Vini, a plurality of reference voltage lines supplied with a reference voltage Vref, and a cathode electrode layer CEL supplied with a cathode voltage VSS.

The pixels P according to an embodiment may be provided in a stripe structure. In this case, each of the pixels P may include a red subpixel, a green subpixel, and a blue subpixel, and moreover, may further include a white subpixel.

According to another embodiment, the plurality of pixels P may be arranged in a pentile structure in the display area AA. In this case, each of the plurality of pixels P may include one red subpixel, two green subpixels, and one blue subpixel, which are one-dimensionally arranged as a polygonal type. For example, each of the pixels P having the pentile structure may include one red subpixel, two green subpixels, and one blue subpixel, which are one-dimensionally arranged as an octagonal type. In this case, the blue subpixel may have a largest size, and each of the two green subpixels may have a smallest size.

Each of a plurality of pixels P arranged in a lengthwise direction of the gate line GL may be connected to a gate line GL, an emission control line ECL, an initialization control line ICL, a sampling control line SCL, a data line DL, a pixel driving voltage line, a initialization voltage line, a reference voltage line, a cathode electrode layer CEL, which pass through a corresponding pixel area. One pixel driving voltage line, one initialization voltage line, and one reference voltage line may be connected to one subpixel or one unit pixel.

Each of the plurality of pixels P may be connected to the gate line GL, the emission control line ECL, the initialization control line ICL, the sampling control line SCL, the data line DL, the pixel driving voltage line, the initialization voltage line, and the reference voltage line and may emit light with a data current corresponding to a data voltage supplied through the data line DL.

The non-display area IA may be provided along an edge of the substrate to surround the display area AA. One non-display area of the non-display area IA may be provided on the substrate and may include a pad part connected to the data lines DL1 to DLp.

The timing controller 300 may align video data Idata input thereto to pixel-based digital data Pdata suitable driving of the light emitting display panel 100 and may generate a data control signal DCS from a timing synchronization signal TSS to supply the data control signal DCS to the data driving circuit 500.

The timing controller 300 may generate a gate control signal GCS including a gate start signal, a plurality of gate clocks, a plurality of carry clocks, a plurality of sampling clocks, and a plurality of initialization clocks, based on the timing synchronization signal TSS and may supply the gate control signal GCS to the gate driving circuit 700. The gate control signal GCS may be supplied to the gate driving circuit 700 via the pad part.

The data driving circuit 500 may be connected to the data lines DL1 to DLp provided in the light emitting display panel 100. The data driving circuit 500 may convert the pixel-based digital data Pdata into a pixel-based analog data voltage by using a plurality of reference gamma voltages, based on the data control signal DCS supplied from the timing controller 300 and may supply the pixel-based data voltage to a corresponding data line DL.

The gate driving circuit 700 may be connected to the first to $m^{th}$ gate lines GL1 to GLm, the first to $m^{th}$ emission control lines ECL1 to ECLm, the first to $m^{th}$ initialization control lines ICL1 to ICLm, and the first to $m^{th}$ sampling control lines SCL1 to SCLm, which are provided in the display area AA. The gate driving circuit 700 may generate and output an initialization control signal, a sampling control signal, a scan signal, and an emission control signal which correspond to an operation timing of each of the pixels P, based on the gate control signal GCS. The gate driving circuit 700 according to an embodiment may generate the scan signal having the same period and a sequentially shifted phase to supply the scan signal to the first to $m^{th}$ gate lines GL1 to GLm, generate the initialization control signal having the same period and a sequentially shifted phase to supply the initialization control signal to the first to $m^{th}$ initialization control lines ICL1 to ICLm, and generate the sampling control signal having the same period and a sequentially shifted phase to supply the sampling control signal to the first to $m^{th}$ sampling control lines SCL1 to SCLm. Also, the gate driving circuit 700 may generate a carry signal having the same period and a sequentially shifted phase, generate the emission control signal including a first gate-off voltage level and a second gate-off voltage level which have different phases, based on at least two different carry signals, and supply the emission control signal to the first to $m^{th}$ emission control lines ECL1 to ECLm.

The gate driving circuit 700 may be formed in a left non-display area and/or a right non-display area of the substrate through a process of manufacturing TFTs of the pixels P. For example, the gate driving circuit 700 may be provided in the left non-display area of the substrate and may operate based on a single feeding manner to supply the scan signal to a plurality of gate lines GL. As another example, the gate driving circuit 700 may be provided in each of the left non-display area and the right non-display area of the substrate and may operate based on a double feeding manner to supply the scan signal to a plurality of gate lines GL. As another example, the gate driving circuit 700 may be provided in each of the left non-display area and the right non-display area of the substrate and may operate based on a double feeding-based interlacing manner to supply the scan signal to a plurality of gate lines GL.

The light emitting display apparatus according to an embodiment of the present disclosure may further include a level shifter unit 900 which level-shifts the gate control signal GCS.

The level shifter unit 900 may level-shift a high logic voltage of the gate control signal GCS to a gate-on voltage level and may level-shift a low logic voltage of the gate control signal GCS to a gate-off voltage level, based on a gate-on voltage supplied from a gate-on voltage source and a gate-off voltage supplied from a gate-off voltage source and may supply the level-shifted gate control signal GCS to the gate driving circuit 700. The level shifter unit 900 may be embedded into the timing controller 300.

Figure 2:
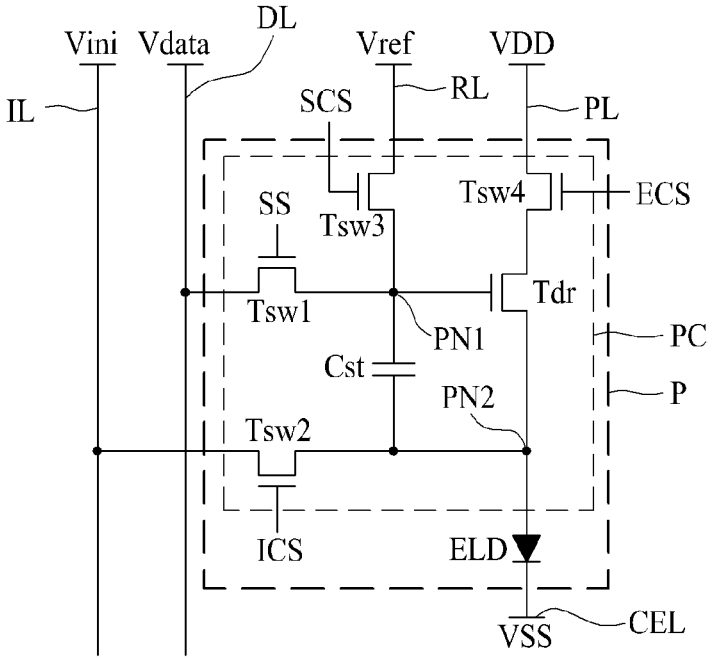
FIG. 2 is a diagram illustrating one pixel according to an embodiment illustrated in FIG. 1 according to an embodiment of the present disclosure.

FIG. 2 is a diagram illustrating one pixel according to an embodiment illustrated in FIG. 1 according to an embodiment of the present disclosure and illustrates one pixel (or one subpixel) connected to an arbitrary gate line and an arbitrary data line of the light emitting display panel.

Referring to FIGS. 1 and 2, a pixel P according to an embodiment of the present disclosure may include a pixel circuit PC and a light emitting device ELD.

The light emitting device ELD may be disposed between a first electrode (or an anode electrode) connected to a pixel circuit PC and a second electrode (or a cathode electrode) connected to a cathode electrode layer CEL. The light emitting device ELD according to an embodiment may include an organic light emitting part, a quantum dot light emitting part, or an inorganic light emitting part, or may include a micro light emitting diode. The light emitting device ELD may emit light with a data current supplied from the pixel circuit PC.

The pixel circuit PC may be connected to a gate line GL, an emission control line ECL, an initialization control line ICL, a sampling control line SCL, a data line DL, a pixel driving voltage line PL, an initialization voltage line IL, and a reference voltage line RL and may supply a data current, corresponding to a data voltage Vdata supplied through the data line DL, to the light emitting device ELD.

The pixel circuit PC according to an embodiment may include a driving transistor Tdr, first to fourth switching transistors Tsw1 to Tsw4, and a storage capacitor Cst.

The driving transistor Tdr may be connected between the pixel driving voltage line PL and the light emitting device ELD and may be turned on based on a voltage of the storage capacitor Cst to control a current flowing from the pixel driving voltage line PL to the light emitting device ELD. The driving transistor Tdr according to an embodiment may include a gate electrode electrically connected to a first pixel node PN1, a source electrode electrically connected to a second pixel node PN2, and a drain electrode electrically connected to the pixel driving voltage line PL.

The first switching transistor Tsw1 may electrically connect the data line DL to a first pixel node PN1 connected to the gate electrode of the driving transistor Tdr in response to a scan signal SS having a gate-on voltage level. The first switching transistor Tsw1 according to an embodiment may include a gate electrode electrically connected to an adjacent gate line GL, a first source/drain electrode electrically connected to an adjacent data line DL, and a second source/drain electrode electrically connected to the first pixel node PN1.

The second switching transistor Tsw2 may electrically connect the initialization voltage line IL to a second pixel node PN2 connected to the source electrode of the driving transistor Tdr in response to an initialization control signal ICS having the gate-on voltage level. The second switching transistor Tsw2 according to an embodiment may include a gate electrode electrically connected to an adjacent initialization control line ICL, a first source/drain electrode electrically connected to the initialization voltage line IL, and a second source/drain electrode electrically connected to the second pixel node PN2.

The third switching transistor Tsw3 may electrically connect the reference voltage line RL to the first pixel node PN1 in response to a sampling control signal SCS having the gate-on voltage level. The third switching transistor Tsw3 according to an embodiment may include a gate electrode electrically connected to an adjacent sampling control line SCL, a first source/drain electrode electrically connected to the first pixel node PN1, and a second source/drain electrode electrically connected to the reference voltage line RL.

The fourth switching transistor Tsw4 may electrically connect the pixel driving voltage line PL to the drain electrode of the driving transistor Tdr in response to an emission control signal ECS having the gate-on voltage level. The fourth switching transistor Tsw4 according to an embodiment may include a gate electrode electrically connected to an adjacent emission control line ECL, a first source/drain electrode electrically connected to the pixel driving voltage line PL, and a second source/drain electrode electrically connected to the drain electrode of the driving transistor Tdr. The fourth switching transistor Tsw4 may be referred to as an emission control transistor.

In the first to fourth switching transistors Tsw1 to Tsw4, the first source/drain electrode or the second source/drain electrode may be defined as a source electrode or a drain electrode, based on a direction of a current.

The driving transistor Tdr and the first to fourth switching transistors Tsw1 to Tsw4 may each include a semiconductor layer, and the semiconductor layer may include an oxide semiconductor material such as zinc oxide (ZnO), indium zinc oxide (InZnO), or indium gallium zinc oxide ($InGaZnO_4$). However, the present embodiment is not limited thereto, and the semiconductor layer may include single crystalline silicon, polycrystalline silicon, or an organic material well known to those skilled in the art, in addition to the oxide semiconductor material. Each of the driving transistor Tdr and the first to fourth switching transistors Tsw1 to Tsw4 may be an N-type TFT, but without being limited thereto, may be implemented as a P-type TFT.

The storage capacitor Cst may be connected between the first pixel node PN1 and the second pixel node PN2. That is, the storage capacitor Cst may be connected between the gate electrode and the source electrode of the driving transistor Tdr. The storage capacitor Cst may store a voltage corresponding to a data voltage and a characteristic voltage of the driving transistor Tdr and may turn on the driving transistor Tdr with the stored voltage. The storage capacitor Cst according to an embodiment may be provided in an overlap area between the first pixel node PN1 and the second pixel node PN2. The storage capacitor Cst according to an embodiment may include a first capacitor electrode electrically connected to the first pixel node PN1, a second capacitor electrode electrically connected to the second pixel node PN2 to overlap the first capacitor electrode, and a capacitance layer between the first capacitor electrode and the second capacitor electrode. The storage capacitor Cst may store the voltage corresponding to the data voltage and the characteristic voltage of the driving transistor Tdr. For example, the characteristic voltage of the driving transistor Tdr may include a threshold voltage.

Figure 3:
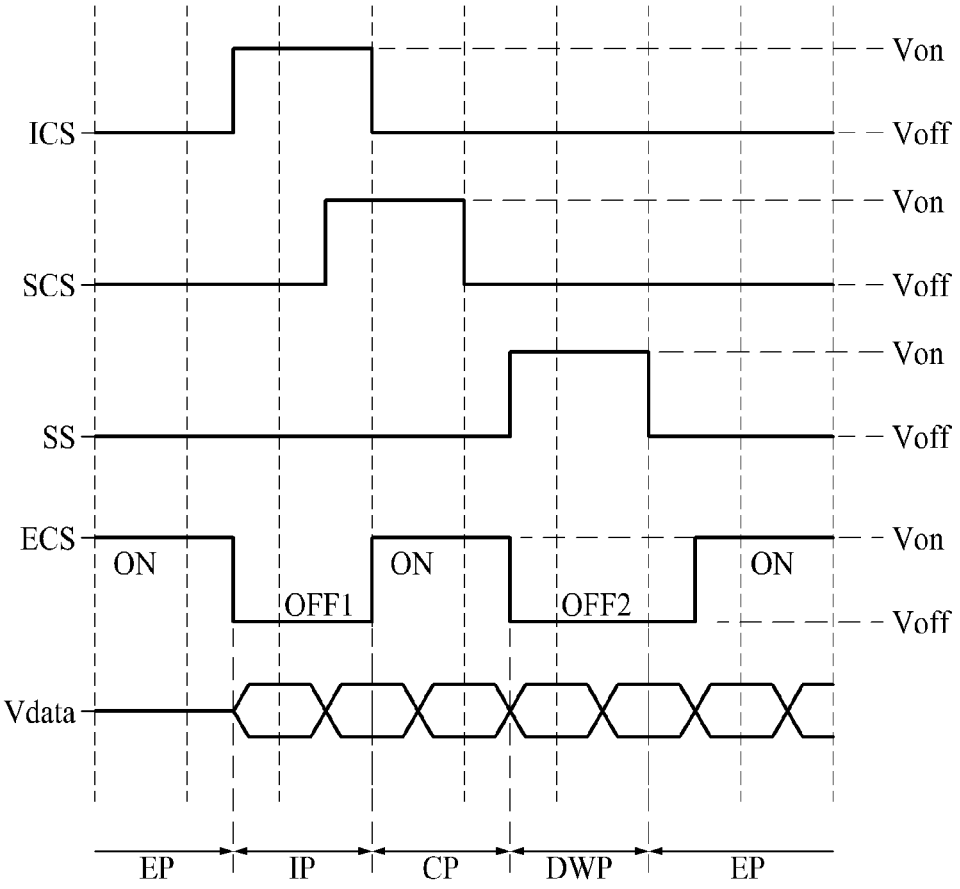
FIG. 3 is an operation timing diagram for describing an operation of the pixel illustrated in FIG. 2 according to an embodiment of the present disclosure.

FIG. 3 is an operation timing diagram for describing an operation of the pixel P illustrated in FIG. 2 according to an embodiment of the present disclosure.

Referring to FIGS. 1 to 3, the pixel P according to an embodiment of the present disclosure may divisionally operate in an initialization period IP, a compensation period (or a sampling period) CP, a data writing period (or a data programming period) DWP, and an emission period EP.

First, in the initialization period IP, the storage capacitor Cst may be initialized by the initialization voltage Vini supplied through the initialization voltage line IL and the reference voltage Vref supplied through the reference voltage line RL in response to the initialization control signal ICS having a gate-on voltage level Von, the sampling control signal SCS having the gate-on voltage level Von, and the emission control signal ECS having a first gate-off voltage level Voff. That is, in the initialization period IP, the fourth switching transistor Tsw4 may be turned off by the emission control signal ECS having the first gate-off voltage level Voff, and the second switching transistor Tsw2 may be turned on by the initialization control signal ICS having the gate-on voltage level Von, whereby the initialization voltage Vini may be supplied to the second pixel node N2. Subsequently, the third switching transistor Tsw3 may be turned on by the sampling control signal SCS having the gate-on voltage level Von, and thus, the reference voltage Vref may be supplied to the first pixel node PN1. Therefore, the storage capacitor Cst may be initialized to an initialization voltage or a difference voltage between the initialization voltage Vini and the reference voltage Vref.

Subsequently, in the compensation period CP, the storage capacitor Cst may store a sampling voltage corresponding to a threshold voltage of the driving transistor Tdr with the pixel driving voltage VDD supplied through the pixel driving voltage line PL and the reference voltage Vref, in response to the sampling control signal SCS having the gate-on voltage level Von and the emission control signal ECS having the gate-on voltage level Von. That is, in the compensation period CP, the fourth switching transistor Tsw4 may be turned on by the emission control signal ECS having the gate-on voltage level Von, the second switching transistor Tsw2 may be turned off by the initialization control signal ICS having a gate-off voltage level Voff, and the third switching transistor Tsw3 may maintain a turn-on state according to the sampling control signal SCS having the gate-on voltage level Von. Therefore, the reference voltage Vref may be supplied to the first pixel node PN1 through the third switching transistor Tsw3, and the second pixel node PN2 may be electrically floated according to the second switching transistor Tsw2 being turned off. Therefore, the driving transistor Tdr may be turned on by the reference voltage Vref of the first pixel node PN1 to operate as a source follower, and when a source voltage is a voltage "Vref−Vth" obtained by subtracting the threshold voltage Vth of the driving transistor Tdr from the reference voltage Vref, the driving transistor Tdr may be turned off. Accordingly, a compensation voltage (or a sampling voltage) corresponding to the threshold voltage Vth of the driving transistor Tdr may be charged into the storage capacitor Cst. For example, a voltage close to the threshold voltage Vth of the driving transistor Tdr or a difference voltage "Vref−Vth" between the reference voltage Vref and the threshold voltage Vth of the driving transistor Tdr may be charged into the storage capacitor Cst.

Subsequently, in the data writing period DWP, the data voltage Vdata supplied through the data line DL may be supplied to the first pixel node PN1 in response to the scan signal SS having the gate-on voltage level Von and the emission control signal ECS having a second gate-off voltage level Voff. That is, in the data writing period DWP, the first switching transistor Tsw1 may be turned on by the scan signal SS having the gate-on voltage level Von, the fourth switching transistor Tsw4 may be turned off (OFF2) by the emission control signal ECS having the second gate-off voltage level Voff, the third switching transistor Tsw3 may be turned off by the sampling control signal SCS having the gate-off voltage level Voff, and the second switching transistor Tsw2 may maintain a turn-off state according to the initialization control signal ICS having the gate-off voltage level Voff. Also, the data driving circuit 500 may supply actual data voltage Vdata to the data line DL. Therefore, the actual data voltage Vdata may be supplied to the first pixel node PN1 through the first switching transistor Tsw1, and the second pixel node PN2 may electrically maintain a floating state according to the second switching transistor Tsw2 being turned off. Therefore, a voltage of the first pixel node PN1 may be shifted from the reference voltage Vref to the actual data voltage Vdata, and a voltage of the second pixel node PN2 having the floating state may be shifted due to voltage coupling caused by the storage capacitor Cst, whereby the compensation voltage corresponding to the threshold voltage Vth of the driving transistor Tdr and a voltage "Vdata−Vref+Vth" corresponding to a data voltage may be charged into the storage capacitor Cst.

Subsequently, in the emission period EP, the light emitting device ELD may emit light with the pixel driving voltage VDD and a voltage of the storage capacitor Cst in response to the emission control signal ECS having the gate-on voltage level Von. That is, in the emission period EP, the fourth switching transistor Tsw4 may be turned on (ON) by the emission control signal ECS having the gate-on voltage level Von, the first switching transistor Tsw1 may be turned off by the scan signal SS having the gate-off voltage level Voff, the second switching transistor Tsw2 may maintain a turn-off state according to the initialization control signal ICS having the gate-off voltage level Voff, and the third switching transistor Tsw3 may maintain a turn-on state according to the sampling control signal SCS having the gate-on voltage level Von. Therefore, a voltage stored in the storage capacitor Cst may be supplied to the first pixel node PN1, and the pixel driving voltage VDD may be supplied to the drain electrode of the driving transistor Tdr through the fourth switching transistor Tsw4. Therefore, the driving transistor Tdr may be turned on by a voltage of the first pixel node PN1 and may supply a data current, corresponding to a voltage stored in the storage capacitor Cst, to the light emitting device ELD to allow the light emitting device ELD to emit light. In this case, the data current supplied from the driving transistor Tdr to the light emitting device ELD may be determined as "$Ioled=\frac{1}{2}\times K(Vdata-Vref-C(Vdata-Vref))^2$", and it may be seen that the data current Ioled is not affected by the threshold voltage of the driving transistor Tdr. Accordingly, in the pixel P according to an embodiment of the present disclosure, a characteristic variation of the driving transistor Tdr is compensated for, and thus, a luminance deviation between pixels P is reduced.

Optionally, in an embodiment of the present disclosure, a time when the emission control signal ECS rises from the gate-off voltage level to the gate-on voltage level may be controlled at a start time of the emission period EP, and thus, a movability deviation of the driving transistor Tdr between pixels P is compensated for.

Figure 4:
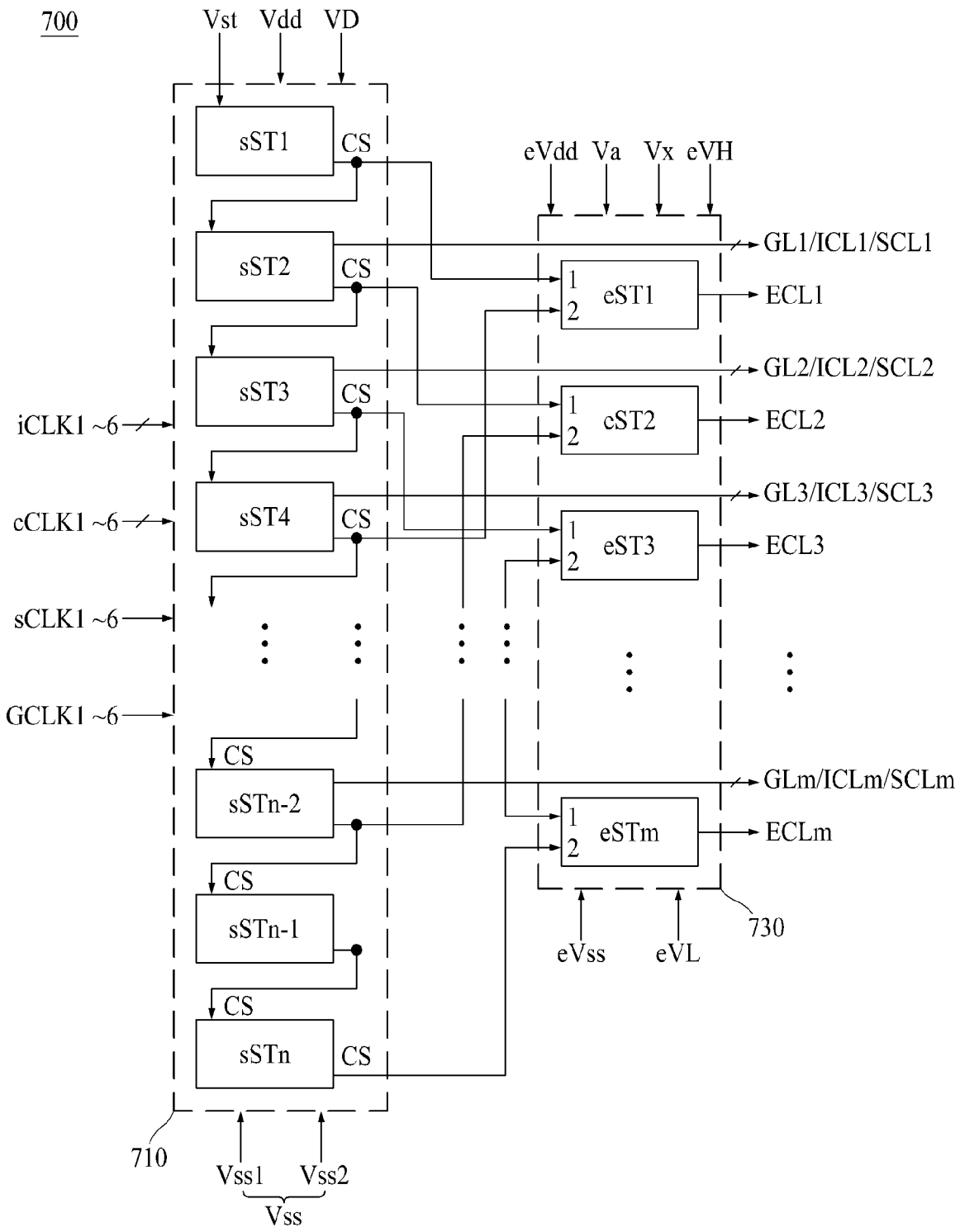
FIG. 4 is a diagram for describing a gate driving circuit according to an embodiment of the present disclosure according to an embodiment of the present disclosure.
Figure 5:
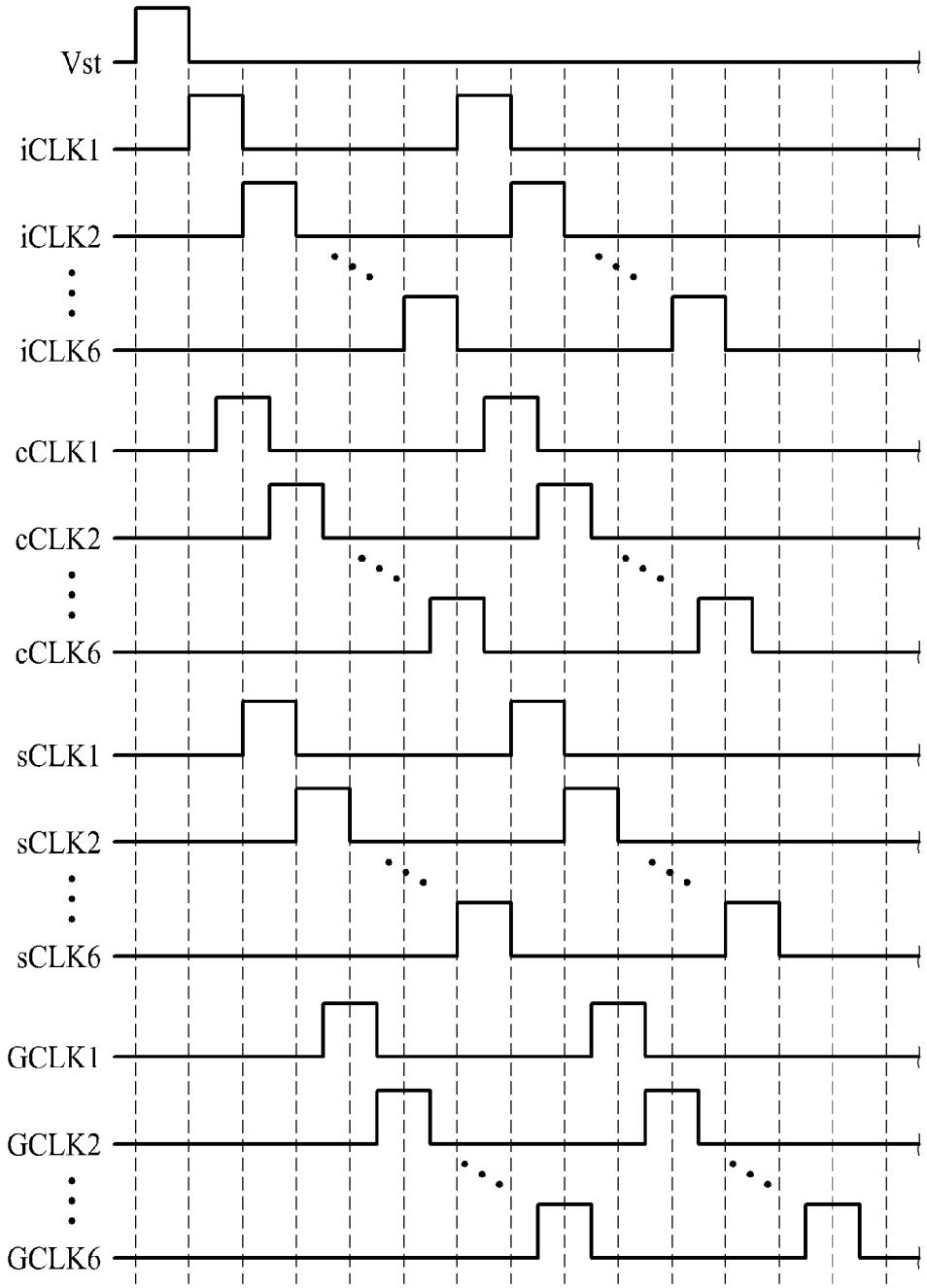
FIG. 5 is a waveform diagram showing a clock supplied to the gate driving circuit illustrated in FIG. 4 according to an embodiment of the present disclosure.

FIG. 4 is a diagram for describing a gate driving circuit according to an embodiment of the present disclosure, and FIG. 5 is a waveform diagram showing a clock supplied to the gate driving circuit illustrated in FIG. 4 according to an embodiment of the present disclosure.

Referring to FIGS. 3 to 5, the gate driving circuit 700 according to an embodiment of the present disclosure may include a scan control shift register 710 and an emission control shift register 730.

The scan control shift register 710 may include first to $n^{th}$ (where n is a natural number equal to or more than m) scan control stages sST1 to sSTn which respectively supply the scan signal SS to the first to $m^{th}$ gate lines GL1 to GLm and supply a carry signal CS to the emission control shift register 730. Also, the scan control shift register 710 may supply the initialization control signal ICS to the first to $m^{th}$ initialization control lines ICL1 to ICLm and may supply the sampling control signal SCS to the first to $m^{th}$ sampling control lines SCL1 to SCLm.

Each of the first to $n^{th}$ scan control stages sST1 to sSTn may output the initialization control signal ICS, the sampling control signal SCS, the scan signal SS, and the carry signal CS, based on a plurality of gate clocks GCLK1 to GCLK6, a plurality of carry clocks cCLK1 to cCLK6, a plurality of initialization clocks iCLK1 to iCLK6, a plurality of sampling clocks sCLK1 to sCLK6, a gate start signal Vst, a stage driving voltage Vdd, and low level voltages Vss1 and Vss2.

Each of the plurality of gate clocks GCLK1 to GCLK6, the plurality of carry clocks cCLK1 to cCLK6, the plurality of initialization clocks iCLK1 to iCLK6, and the plurality of sampling clocks sCLK1 to sCLK6 may include a gate-on voltage period and a gate-off voltage period which are repeated at a predetermined interval. In the plurality of gate clocks GCLK1 to GCLK6, the plurality of carry clocks cCLK1 to cCLK6, the plurality of initialization clocks iCLK1 to iCLK6, and the plurality of sampling clocks sCLK1 to sCLK6, the gate-on voltage periods may be shifted by 1.5 horizontal periods and may not overlap each other, but are not limited thereto. In other embodiments, based on a driving timing of a pixel, the gate-on voltage period may be shifted by an arbitrary horizontal period, or may overlap each other during an arbitrary period. Hereinafter, an example where the first to $n^{th}$ scan control stages sST1 to sSTn uses 6-phase clocks will be described.

A gate-on voltage period of a $k^{th}$ (where k is a natural number from one to six) sampling clock sCLKk of the plurality of sampling clocks sCLK1 to sCLK6 may overlap a portion (for example, during 0.5 horizontal periods) of a $k^{th}$ initialization clock iCLKk of the plurality of initialization clocks iCLK1 to iCLK6, but is not limited thereto. In other embodiments, in an initialization period and a compensation period of a pixel, the gate-on voltage period of the $k^{th}$ sampling clock sCLKk may be shifted based on a charging/discharging characteristic of a pixel and/or a storage capacitor.

A gate-on voltage period of a $k^{th}$ carry clock cCLKk of the plurality of carry clocks cCLK1 to cCLK6 may overlap the $k^{th}$ initialization clock iCLKk and a $k^{th}$ sampling clock sCLKk. In this case, a rising period of the $k^{th}$ carry clock cCLKk may be set as a period between a rising period of the $k^{th}$ initialization clock iCLKk and a rising period of the $k^{th}$ sampling clock sCLKk, and a falling period of the $k^{th}$ carry clock cCLKk may be set as a period between a falling period of the $k^{th}$ initialization clock iCLKk and a falling period of the $k^{th}$ sampling clock sCLKk. Here, the rising period may be defined as a period where a gate-off voltage is shifted to a gate-on voltage level, and the falling period may be defined as a period where a gate-on voltage is shifted to a gate-off voltage level.

A gate-on voltage period of a $k^{th}$ gate clock GCLKk of the plurality of gate clocks GCLK1 to GCLK6 may be shifted by 1.5 horizontal periods from a gate-on voltage period of the $k^{th}$ initialization clock iCLKk, but is not limited thereto. In other embodiments, in the data writing period DWP of the pixel P, the gate-on voltage period of the $k^{th}$ gate clock GCLKk may be shifted based on a charging characteristic of a data voltage.

Each of the $k^{th}$ gate clock GCLKk, the $k^{th}$ initialization clock iCLKk, the $k^{th}$ sampling clock sCLKk, and the $k^{th}$ initialization clock iCLKk may be supplied to a $6x-y^{th}$ (where x is a natural number, and y is a natural number "6−k") scan control stage sST6*x*−*y*.

The first to $n^{th}$ scan control stages sST1 to sSTn may be dependently connected to one another so as to be enabled by the gate start signal Vst or the carry signal CS supplied from a $q^{th}$ (where q is a natural number) front scan control stage and to be reset by a stage reset signal or the carry signal CS supplied from an $r^{th}$ (where r is a natural number) rear scan control stage. For example, a first scan control stage sST1 may be enabled by the gate start signal Vst and may be reset by the carry signal CS output from the fifth scan control stage sST5.

Each of the first to $n^{th}$ scan control stages sST1 to sSTn according to the present embodiment may output a corresponding initialization clock of the initialization clocks iCLK1 to iCLK6 as the initialization control signal ICS during the initialization period IP of the pixel P, output a corresponding sampling clock of the sampling clocks sCLK1 to sCLK6 as the sampling control signal SCS during the compensation period CP of the pixel P, output a corresponding gate clock of the gate clocks GCLK1 to GCLK6 as the scan signal SS during the data writing period DWP of the pixel P, and output a corresponding carry clock of the carry clocks cCLK1 to cCLK6 as the carry signal CS during a period between a latter part (or a second half) of the initialization period IP and a fore part (or a first half) of the compensation period CP of the pixel P. In this case, a fore part (or a first half) of the sampling control signal SCS may overlap a latter part (or a second half) of the initialization control signal ICS.

The emission control shift register 730 may include first to $m^{th}$ emission control stages eST1 to eSTm which respectively supply the emission control signal ECS to the first to $m^{th}$ emission control lines ECL1 to ECLm to turn on a transistor included in a pixel connected to each of the first to $m^{th}$ emission control lines ECL1 to ECLm.

The emission control shift register 730 is connected to the scan control shift register 710 and receives input signals from the control shift register 710. For example, each of the first to $m^{th}$ emission control stages eST1 to eSTm emission control stage included in the emission control shift register 730 may receive a first input signal and a second input signal from the scan control shift register 710. Each of the first to $m^{th}$ emission control stages eST1 to eSTm may output the emission control signal ECS corresponding to an operation timing of the pixel P, based on the first input signal supplied to a first input terminal 1 and the second input signal supplied to a second input terminal 2.

When at least one of the first and second input signals which differ has a high voltage level (e.g., a first voltage level) (or the gate-on voltage level), each of the first to $m^{th}$ emission control stages eST1 to eSTm according to an embodiment may output the emission control signal ECS having the gate-off voltage level Voff, and when all of the first and second input signals which differ have a low voltage level (e.g., a second voltage level that is less than the first voltage level) (or the gate-off voltage level that is less than the gate-on voltage level), each of the first to $m^{th}$ emission control stages eST1 to eSTm according to an embodiment may output the emission control signal ECS having the gate-on voltage level Von. For example, each of the first to $m^{th}$ emission control stages eST1 to eSTm may output the emission control signal ECS having the gate-off voltage level Voff in response to the first input signal having a high voltage level and may output the emission control signal ECS having the second gate-off voltage level OFF2 in response to the second input signal having a high voltage level. In this case, the second input signal having a high voltage level may be delayed during at least three horizontal periods from the first input signal having a high voltage level.

The first input signal input to an $i^{th}$ (where i is one to m) emission control stage eSTi of the first to $m^{th}$ emission control stages eST1 to eSTm may be the carry signal CS output from a $j-a^{th}$ (where j is one to m, and a is a natural number) scan control stage sSTj−a of the first to $n^{th}$ scan control stages sST1 to sSTn, and the second input signal input to the $i^{th}$ emission control stage eSTi may be the carry signal CS output from a $j+b^{th}$ (where b is a natural number more than a) scan control stage sSTj+b of the first to $n^{th}$ scan control stages sST1 to sSTn. Here, the $j^{th}$ scan control stage sSTj may be defined as a scan control stage disposed closest to the $i^{th}$ scan control stage sSTi of the first to $n^{th}$ scan control stages sST1 to sSTn.

To describe a disposition structure of the scan control stages and the emission control stages illustrated in FIG. 4, for example, the first input terminal 1 of the first emission control stage eST1 may receive the carry signal CS as the first input signal from the first scan control stage sST1, and the second input terminal 2 of the first emission control stage eST1 may receive the carry signal CS as the second input signal from the second scan control stage sST4. As another example, the first input terminal 1 of the first emission control stage eST1 may receive, as the first input signal, the carry signal CS output from a scan control dummy stage previous to the first scan control stage sST1, and the second input terminal 2 of the first emission control stage eST1 may receive, as the second input signal, the carry signal CS output from the fifth scan control stage sST5. Therefore, the first and second input signals input to the first to $m^{th}$ emission control stages eST1 to eSTm may be determined based on an operation timing of each pixel, and for example, may be changed based on a time of the compensation period based on a charging/discharging characteristic of each pixel and/or the storage capacitor in the initialization period and the compensation period of each pixel.

Each of the first to $m^{th}$ emission control stages eST1 to eSTm according to the present embodiment may output the emission control signal ECS having the first gate-off voltage level Voff during the initialization period IP of a corresponding pixel P in response to the first input signal and may output the emission control signal ECS having the second gate-off voltage level OFF2 during the data writing period DWP in response to the second input signal.

The first input signal input to a portion of the first to $m^{th}$ emission control stages eST1 to eSTm and the second input signal input to a different portion of the first to $m^{th}$ emission control stages eST1 to eSTm may be provided by the timing controller 300. The first to $g^{th}$ (where g is a natural number equal to or less than twenty) emission control stages of the first to $m^{th}$ emission control stages eST1 to eSTm may receive the first input signal from the timing controller 300. Also, the $m^{th}$ to $m-h^{th}$ (where h is a natural number which is equal to g or less than twenty) emission control stages of the first to $m^{th}$ emission control stages eST1 to eSTm may receive the second input signal from the timing controller 300. In this case, in the present embodiment, some of n number of scan stages included in the scan shift register may be omitted, and for example, g number of dummy scan control stages which supply the first input signal to the first to $g^{th}$ emission control stages and h number of dummy scan control stages which supply the second input signal to the first to $h^{th}$ emission control stages may be omitted, thereby reducing a size of the gate driving circuit. For example, the first emission control stage eST1 may receive the first input signal from the timing controller 300 and may receive the carry signal of the second scan control stage sST2 as the second input signal. Also, the $m^{th}$ emission control stage eSTm may receive the first input signal from the $n^{th}$ scan control stage sSTn and may receive the second input signal from the timing controller 300.

As described above, in the gate driving circuit 700 according to an embodiment of the present disclosure, since the emission control shift register 730 outputs the emission control signal, based on the carry signal CS output from the scan control stage of the scan control shift register 710, a configuration of a circuit is simplified, and the emission control signal is stably output, thereby enhancing the reliability of driving. Accordingly, a bezel width of the light emitting display apparatus is reduced.

Figure 6:
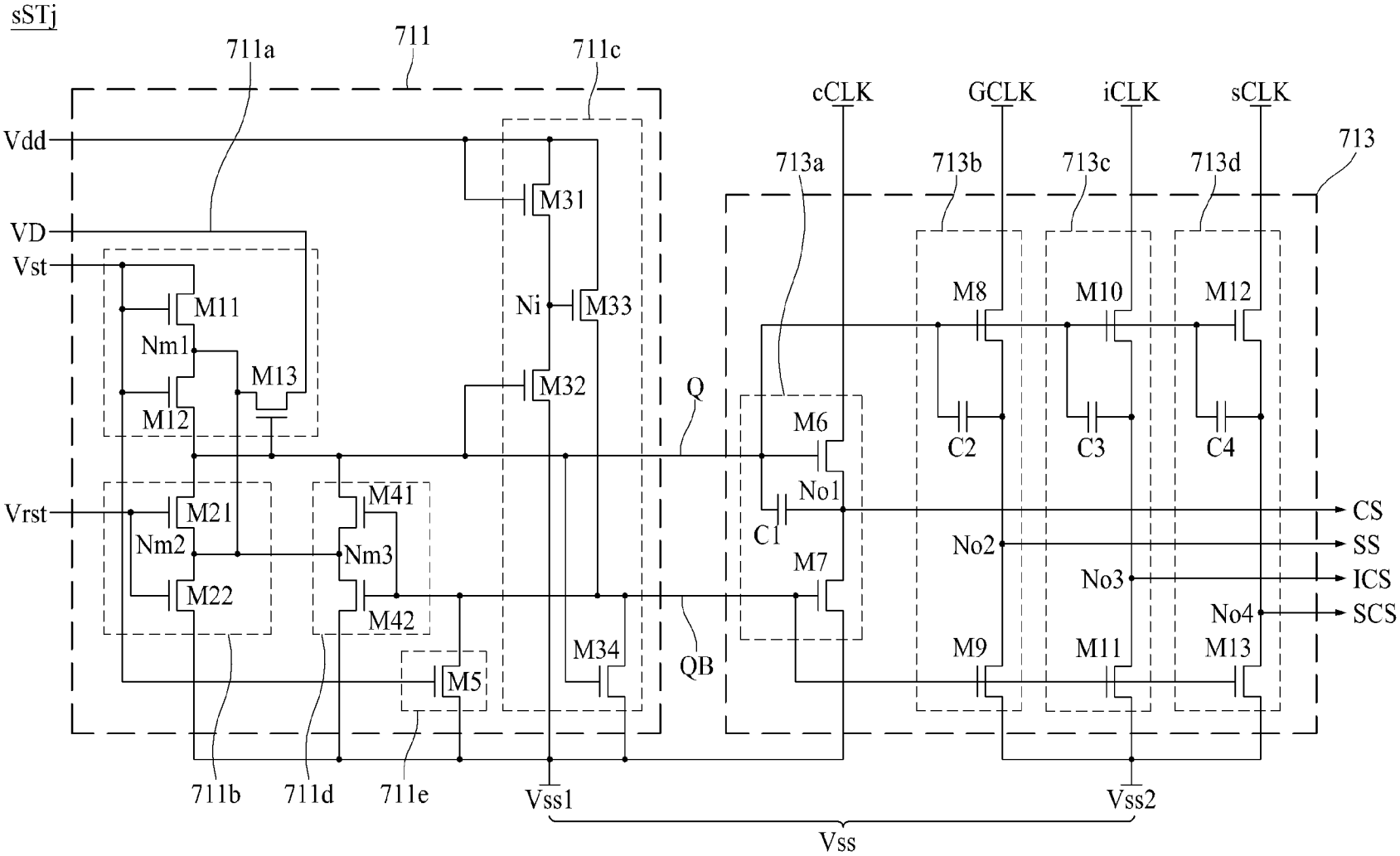
FIG. 6 is a circuit diagram for describing a circuit configuration of a $j^{th}$ scan control stage illustrated in FIG. 4 according to an embodiment of the present disclosure.

FIG. 6 is a circuit diagram for describing a circuit configuration of the $j^{th}$ scan control stage illustrated in FIG. 4 according to an embodiment of the present disclosure.

Referring to FIGS. 4 to 6, a scan control stage sSTj may include a node controller 711 and a scan output part 713.

The node controller 711 may control a voltage of a first node Q and a voltage of a second node QB in response to a gate start signal Vst or a carry signal from a $q^{th}$ (where q is a natural number) front scan control stage and a stage reset signal Vrst or a carry signal from a $r^{th}$ (where r is a natural number) rear scan control stage. That is, the node controller 711 may charge the first node Q with a voltage in response to the gate start signal Vst or the carry signal from the $q^{th}$ front scan control stage, and in response to the stage reset signal Vrst or the carry signal from the $r^{th}$ rear scan control stage, the node controller 711 may discharge the voltage of the first node Q and may control the voltage of the second node QB to a voltage opposite to the voltage of the first node Q.

The node controller 711 according to an embodiment may include a first node voltage setting part 711*a*, a first node voltage reset part 711*b*, a second node voltage setting part 711*c*, and a noise removal part 711*d*.

The first node voltage setting part 711*a* may set the voltage of the first node Q in response to the gate start signal Vst. Here, the gate start signal Vst may be the carry signal output the $q^{th}$ front scan control stage.

The first node voltage setting part 711*a* according to an embodiment may include $1\text{-}1^{th}$ to $1\text{-}3^{th}$ transistors M11 to M13.

The $1\text{-}1^{th}$ and $1\text{-}2^{th}$ transistors M11 and M12 may be serially connected to the first node Q and may be simultaneously turned on based on the gate start signal Vst to charge the first node Q with a gate-on voltage.

The $1\text{-}3^{th}$ transistor M13 may be turned on based on the voltage of the first node Q and may supply a transistor offset voltage VD to a first middle node Nm1 between the $1\text{-}1^{th}$ transistor M11 and the $1\text{-}2^{th}$ transistor M12. When the gate start signal Vst is shifted to a gate-off voltage and thus the $1\text{-}1^{th}$ transistor M11 and the $1\text{-}2^{th}$ transistor M12 are turned off, the $1\text{-}3^{th}$ transistor M13 may supply the transistor offset voltage VD to the first middle node Nm1 to completely turn off the $1\text{-}2^{th}$ transistor M12, thereby preventing the current leakage of the first node Q. The $1\text{-}3^{th}$ transistor M13 may be electrically connected to a first node of the $q^{th}$ front scan control stage, and in this case, the $1\text{-}3^{th}$ transistor M13 may precharge the voltage of the first node Q with a voltage of the first node of the $q^{th}$ front scan control stage, thereby preventing the current leakage of the first node Q.

The first node voltage reset part 711*b* may reset the voltage of the first node Q in response to the stage reset signal Vrst. Here, the stage reset signal Vrst may be the carry signal from the $r^{th}$ rear scan control stage.

The first node voltage reset part 711*b* according to an embodiment may include $2\text{-}1^{th}$ and $2\text{-}2^{th}$ transistors M21 and M22.

The $2\text{-}1^{th}$ and $2\text{-}2^{th}$ transistors M21 and M22 may be serially connected between the first node Q and a first low level voltage line through which a first low level voltage Vss1 is supplied, and may be simultaneously turned on based on the stage reset signal Vrst having the gate-on voltage level to discharge the voltage of the first node Q.

A second middle node Nm2 between the $2\text{-}1^{th}$ and $2\text{-}2^{th}$ transistors M21 and M22 may be electrically connected to the first middle node Nm1 of the first node voltage setting part 711*a* and may be supplied with the transistor offset voltage VD from the $1\text{-}3^{th}$ transistor M13 of the first node voltage setting part 711*a*. Therefore, when the $2\text{-}1^{th}$ transistor M21 is in a turn-off state according to the stage reset signal Vst having the gate-off voltage, a source voltage of the $2\text{-}1^{th}$ transistor M21 may have a voltage level higher than that of a gate voltage of the $2\text{-}1^{th}$ transistor M21 according to the transistor offset voltage VD supplied to the second middle node Nm2, and thus, may maintain a complete turn-off state, thereby preventing the current leakage of the first node Q.

The second node voltage setting part 711*c* may set the voltage of the second node QB with the voltage of the first node Q, based on the stage driving voltage Vdd and the first low level voltage Vss1, thereby controlling the voltage of the second node QB to a voltage opposite to the voltage of the first node Q.

The second node voltage setting part 711*c* according to an embodiment may include $3\text{-}1^{th}$ to $3\text{-}4^{th}$ transistors M31 to M34.

The $3\text{-}1^{th}$ transistor M31 may be turned on based on the stage driving voltage Vdd and may supply the stage driving voltage Vdd to an internal node Ni to set a voltage of the internal node Ni to the stage driving voltage Vdd.

The $3\text{-}2^{th}$ transistor M32 may be turned on/off based on the voltage of the first node Q, and when the $3\text{-}2^{th}$ transistor M32 is turned on, the $3\text{-}2^{th}$ transistor M32 may supply the first low level voltage Vss1 to the internal node Ni to reset (or discharge) the voltage of the internal node Ni to the first low level voltage Vss1.

The $3\text{-}3^{th}$ transistor M33 may be turned on/off based on the voltage of the internal node Ni, and when the $3\text{-}3^{th}$ transistor M33 is turned off, the $3\text{-}3^{th}$ transistor M33 may supply the stage driving voltage Vdd to the second node QB to set the voltage of the second node QB to the stage driving voltage Vdd.

The $3\text{-}4^{th}$ transistor M34 may be turned on/off based on the voltage of the first node Q, and when the $3\text{-}4^{th}$ transistor M34 is turned on, the $3\text{-}4^{th}$ transistor M34 may supply the first low level voltage Vss1 to the second node QB to reset (or discharge) the voltage of the second node QB to the first low level voltage Vss1.

When the $3\text{-}2^{th}$ transistor M32 is turned off based on the voltage of the first node Q, the second node voltage setting part 711*c* according to the present embodiment may charge the internal node Ni with the stage driving voltage Vdd through the $3\text{-}1^{th}$ transistor M31 turned on based on the stage driving voltage Vdd and may charge the second node QB with the stage driving voltage Vdd through the $3\text{-}3^{th}$ transistor M33 turned on based on the voltage of the internal node Ni, thereby setting the voltage of the second node QB to the stage driving voltage Vdd. On the other hand, when the $3\text{-}2^{th}$ transistor M32 is turned on based on the voltage of the first node Q, the second node voltage setting part 711*c* according to the present embodiment may reset the voltage of the internal node Ni to the first low level voltage Vss1 through the turned-on $3\text{-}2^{th}$ transistor M32 to reset the $3\text{-}3^{th}$ transistor M33, and simultaneously, may reset the voltage of the second node QB to the first low level voltage Vss1 through the $3\text{-}4^{th}$ transistor M34 turned on based on the voltage of the first node Q. At this time, even when the stage driving voltage Vdd is supplied to the internal node Ni through the $3\text{-}1^{th}$ transistor M31 turned on based on the stage driving voltage Vdd, the voltage of the internal node Ni may be reset to the first low level voltage Vss1 through the turned-on $3\text{-}2^{th}$ transistor M32, and thus, the $3\text{-}2^{th}$ transistor M32 connected to the internal node Ni may be turned off. To this end, the 3–2$^{th}$ transistor M32 may have a channel size which is relatively larger than that of the 3–1$^{th}$ transistor M31.

Optionally, according to another embodiment, the second node voltage setting part 711*c* may be configured with one of inverters disclosed in FIGS. 29 to 32 of Korean Patent Publication No. 10-2014-0032792.

The noise removal part 711*d* may reset the voltage of the first node Q in response to the voltage of the second node QB. That is, the noise removal part 711*d* may supply the first low level voltage Vss1 to the first node Q in response to the voltage of the second node QB, thereby removing noise which occurs in the first node Q due to coupling caused by the phase shifts of the clocks cCLK, GCLK, iCLK, and sCLK supplied to the scan output part 713.

The noise removal part 711*d* according to an embodiment may include 4–1$^{th}$ and 4–2$^{th}$ transistors M41 and M42.

The 4–1$^{th}$ and 4–2$^{th}$ transistors M41 and M42 may be serially connected between the first node Q and the first low level voltage line through which the first low level voltage Vss1 is supplied, and may be simultaneously turned on based on the stage driving voltage Vdd supplied to the second node QB to reset (or discharge) the voltage of the first node Q to the first low level voltage Vss1.

A third middle node Nm3 between the 4–1$^{th}$ and 4–2$^{th}$ transistors M41 and M42 may be electrically connected to the first middle node Nm1 of the first node voltage setting part 711*a* and may be supplied with the transistor offset voltage VD from the 1–3$^{th}$ transistor M13 of the first node voltage setting part 711*a*. Therefore, when the 4–1$^{th}$ transistor M41 is in a turn-off state according to the first low level voltage Vss1 supplied to the second node QB, a source voltage of the 4–1$^{th}$ transistor M41 may have a voltage level higher than that of a gate voltage of the 4–1$^{th}$ transistor M41 according to the transistor offset voltage VD supplied to the third middle node Nm3, and thus, may maintain a complete turn-off state, thereby preventing the current leakage of the first node Q.

The node controller 711 according to the present embodiment may further include a second node voltage reset part 711*e*.

The second node voltage reset part 711*e* may reset the voltage of the second node QB to the first low level voltage Vss1 in response to the gate start signal Vst (or the carry signal from the q$^{th}$ front scan control stage).

The second node voltage reset part 711*e* according to an embodiment may include a fifth transistor M5 which is turned on/off based on the gate start signal Vst, and when turned on, supplies the first low level voltage Vss1 to the second node QB.

The fifth transistor M5 may be turned on simultaneously with the 1–1$^{th}$ and 1–2$^{th}$ transistors M12 and M22 of the first node voltage setting part 711*a*, and when the voltage of the first node Q is set by the 1–1$^{th}$ and 1–2$^{th}$ transistors M12 and M22, the fifth transistor M5 may reset the voltage of the second node QB to the low level voltage Vss1.

The scan output part 713 may include first to fourth signal output circuits 713*a* to 713*d* which respectively output a carry signal CS, a scan signal SS, an initialization control signal ICS, and a sampling control signal SCS, based on the voltage of the first node Q and the voltage of the second node QB.

The first signal output circuit 713*a* may output a carry clock cCLK or the first low level voltage Vss1 having the gate-off voltage level as the carry signal CS according to the voltage of the first node Q and the voltage of the second node QB. The first signal output circuit 713*a* according to an embodiment may include a sixth transistor M6, which outputs the carry clock cCLK as the carry signal CS having the gate-on voltage level according to the voltage of the first node Q, and a seventh transistor M7 which outputs the first low level voltage Vss1 as the carry signal CS having the gate-off voltage level according to the voltage of the second node Q. The first signal output circuit 713*a* according to an embodiment may further include a first capacitor C1 connected between a gate electrode of the sixth transistor M6 and a first output node No1. For example, the first capacitor C1 may be a parasitic capacitor between the gate electrode and a source electrode of the sixth transistor M6.

The second signal output circuit 713*b* may output a gate clock GCLK or the second low level voltage Vss2 having the gate-off voltage level as the scan signal SS, based on the voltage of the first node Q and the voltage of the second node QB. The second signal output circuit 713*b* according to an embodiment may include an eighth transistor M8, which outputs the gate clock GCLK as the scan signal SS having the gate-on voltage level according to the voltage of the first node Q, and a ninth transistor M9 which outputs the second low level voltage Vss2 as the scan signal SS having the gate-off voltage level according to the voltage of the second node Q. The second signal output circuit 713*b* according to an embodiment may further include a second capacitor C2 connected between a gate electrode of the eighth transistor M8 and a second output node No2. For example, the second capacitor C2 may be a parasitic capacitor between the gate electrode and a source electrode of the eighth transistor M8.

The third signal output circuit 713*c* may output an initialization clock iCLK or the second low level voltage Vss2 having the gate-off voltage level as the initialization control signal ICS, based on the voltage of the first node Q and the voltage of the second node QB. The third signal output circuit 713*c* according to an embodiment may include a tenth transistor M10, which outputs the initialization clock iCLK as the initialization control signal ICS having the gate-on voltage level according to the voltage of the first node Q, and an eleventh transistor M11 which outputs the second low level voltage Vss2 as the initialization control signal ICS having the gate-off voltage level according to the voltage of the second node Q. The third signal output circuit 713*c* according to an embodiment may further include a third capacitor C3 connected between a gate electrode of the tenth transistor M10 and a third output node No3. For example, the third capacitor C3 may be a parasitic capacitor between the gate electrode and a source electrode of the tenth transistor M10.

The fourth signal output circuit 713*d* may output a sampling clock sCLK or the second low level voltage Vss2 having the gate-off voltage level as the sampling control signal SCS, based on the voltage of the first node Q and the voltage of the second node QB. The fourth signal output circuit 713*d* according to an embodiment may include a twelfth transistor M12, which outputs the sampling clock sCLK as the sampling control signal SCS having the gate-on voltage level according to the voltage of the first node Q, and a thirteenth transistor M13 which outputs the second low level voltage Vss2 as the sampling control signal SCS having the gate-off voltage level according to the voltage of the second node Q. The fourth signal output circuit 713*d* according to an embodiment may further include a fourth capacitor C4 connected between a gate electrode of the twelfth transistor M12 and a fourth output node No4. For example, the fourth capacitor C4 may be a parasitic capacitor between the gate electrode and a source electrode of the twelfth transistor M12.

In the scan control shift register including the scan control stage according to the present embodiment, the stage driving voltage Vdd may be equal to or different from the transistor offset voltage VD, the first low level voltage Vss1 may be equal to or different from the second low level voltage Vss2, and the first low level voltage Vss1 may have a voltage level which is equal to or higher than the second low level voltage Vss2.

The transistors M11 to M13 configuring each of the first to $n^{th}$ scan control stages sST1 to sSTn of the scan control shift register according to the present embodiment may be an N-type TFT or a P-type TFT, which includes a semiconductor layer including an oxide semiconductor material, single crystalline silicon, polycrystalline silicon, or an organic material.

Figure 7:
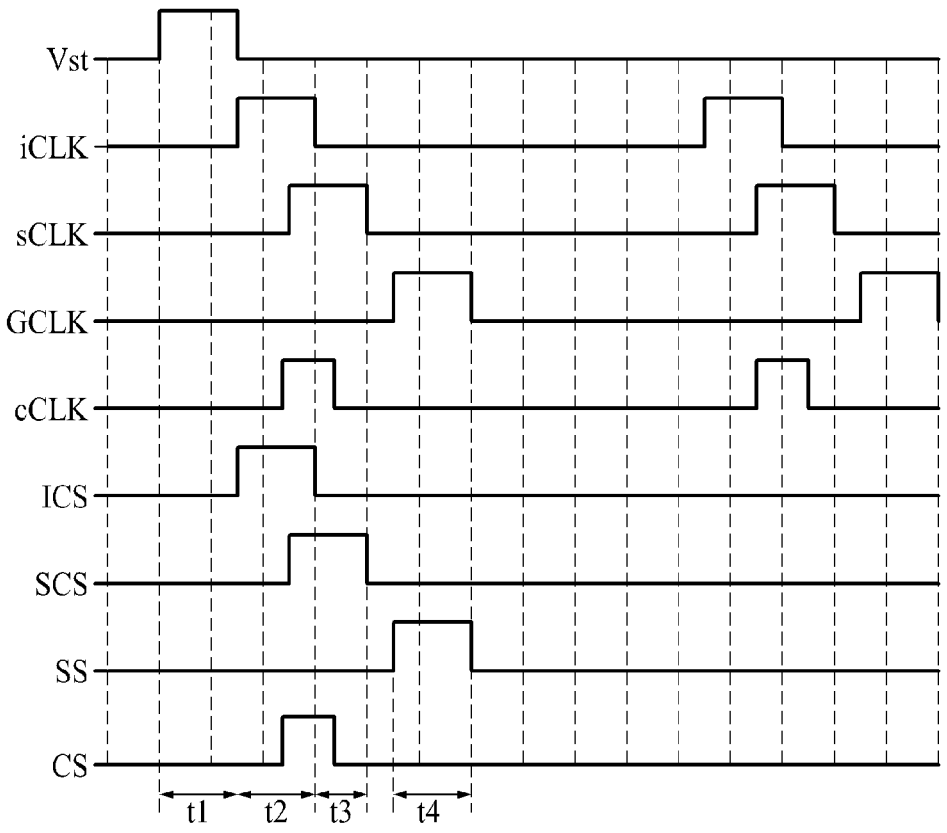
FIG. 7 is a driving waveform diagram of the scan control stage illustrated in FIG. 6 according to an embodiment of the present disclosure.

FIG. 7 is a driving waveform diagram of the scan control stage illustrated in FIG. 6 according to an embodiment of the present disclosure.

An operation of the $j^{th}$ scan control stage sSTj illustrated in FIG. 6 will be described with reference to FIGS. 6 and 7.

First, the $j^{th}$ scan control stage sSTj may sequentially output the initialization control signal ICS, the carry signal CS, the sampling control signal SCS, and the scan signal SS during first to fourth periods t1 to t4.

In the first period t1, the gate-on voltage of the gate start signal Vst may be charged into the first node Q, based on the gate start signal Vst having the gate-on voltage level. That is, in the first period t1, the $1-1^{th}$ and $1-2^{th}$ transistors M11 and M12 of the first node voltage setting part 711*a* may be simultaneously turned on by the gate start signal Vst having the gate-on voltage level, and thus, the gate-on voltage of the gate start signal Vst may be charged into the first node Q. Therefore, the sixth, eighth, tenth, and twelfth transistors M6, M8, M10, and M12 of the scan output part 713 may be turned on by a gate high voltage of the first node Q and may respectively output the carry clock cCLK, the gate clock GCLK, the initialization clock iCLK, and the sampling clock sCLK having the gate-off voltage as the carry signal CS, the scan signal SS, the initialization control signal ICS, and the sampling control signal SCS having the gate-off voltage. Simultaneously, the $2-1^{th}$ and $2-2^{th}$ transistors M21 and M22 of the first node voltage reset part 711*b* may be turned off by the stage reset signal Vrst having the gate-off voltage level. At this time, the $2-1^{th}$ transistor M21 may be completely turned off by the transistor offset voltage VD supplied from the $1-3^{th}$ transistor M13 of the first node voltage setting part 711*a* to the second middle node Nm2, and thus, the current leakage of the first node Q is prevented. The second node voltage setting part 711*c* may reset the voltage of the second node QB to the first low level voltage Vss1 in response to the gate high voltage of the first node Q, and thus, the $4-1^{th}$ and $4-2^{th}$ transistors M41 and M42 of the noise removal part 711*d* may be turned off by the first low level voltage Vss1 of the second node QB. At this time, the $4-1^{th}$ transistor M41 of the noise removal part 711*d* may be completely turned off by the transistor offset voltage VD supplied from the $1-3^{th}$ transistor M13 of the first node voltage setting part 711*a* to the third middle node Nm3, and thus, the current leakage of the first node Q is prevented. The second node voltage setting part 711*c* may reset the voltage of the second node QB to the first low level voltage Vss1 in response to the gate start signal Vst having the gate-on voltage level.

In the second period t2, the gate start signal Vst may be shifted to the gate-off voltage level, and the initialization clock iCLK, the carry clock cCLK, and the sampling clock sCLK having the gate-off voltage level may be sequentially shifted to the gate-on voltage level. Therefore, in the second period t2, the $1-1^{th}$ and $1-2^{th}$ transistors M11 and M12 of the first node voltage setting part 711*a* may be turned off by the gate start signal Vst having the gate-off voltage level, and thus, the first node Q may be floated in a state of having the gate-on voltage level. The voltage of the first node Q having a floating state may increase to a higher voltage according to bootstrapping caused by coupling of the third capacitor C3 and the gate-on voltage level of the initialization clock iCLK applied to the scan output part 713 in the floating state of the first node Q, and thus, the sixth, eighth, tenth, and twelfth transistors M6, M8, M10, and M12 of the scan output part 713 may be completely turned on by the higher voltage of the first node Q. Therefore, in the second period t2, the initialization clock iCLK, the carry clock cCLK, and the sampling clock sCLK having the gate-on voltage level may be respectively output as the initialization control signal ICS, the carry signal CS, and the sampling control signal SCS having the gate-on voltage level through corresponding transistors M6, M10, and M12, and the gate clock GCLK having the gate-off voltage level may be output as the scan signal SS having the gate-off voltage level through the eighth transistor M8. At this time, in the second period t2, the first node voltage reset part 711*b*, the second node voltage setting part 711*c*, the noise removal part 711*d*, and the second node voltage reset part 711*e* may be maintained in a state which is set in the first period t1. In the second period t2, the voltage of the first node Q may be bootstrapped whenever the initialization clock iCLK, the carry clock cCLK, and the sampling clock sCLK having the gate-off voltage level are sequentially shifted to the gate-on voltage level.

In the third period t3, the initialization clock iCLK, the carry clock cCLK, and the sampling clock sCLK having the gate-on voltage level may be sequentially shifted to the gate-off voltage level. In the third period t3, the sixth, eighth, tenth, and twelfth transistors M6, M8, M10, and M12 of the scan output part 713 may maintain a turn-on state. Therefore, in the third period t3, the initialization clock iCLK, the carry clock cCLK, and the sampling clock sCLK having the gate-off voltage level may be respectively output as the initialization control signal ICS, the carry signal CS, and the sampling control signal SCS having the gate-off voltage level through corresponding transistors M6, M10, and M12, and the gate clock GCLK having the gate-off voltage level may be output as the scan signal SS having the gate-off voltage level through the eighth transistor M8. At this time, in the third period t3, the first node voltage reset part 711*b*, the second node voltage setting part 711*c*, the noise removal part 711*d*, and the second node voltage reset part 711*e* may be maintained in a state which is set in the first period t1. In the third period t3, the voltage of the first node Q may be lowered whenever the initialization clock iCLK, the carry clock cCLK, and the sampling clock sCLK having the gate-on voltage level are sequentially shifted to the gate-off voltage level.

In the fourth period t4, the initialization clock iCLK, the carry clock cCLK, and the sampling clock sCLK may be maintained at the gate-off voltage level, and the gate clock GCLK having the gate-off voltage level may be shifted to the gate-on voltage level. The voltage of the first node Q having a floating state may again increase to a higher voltage according to bootstrapping caused by coupling of the second capacitor C2 and the gate-on voltage level of the gate clock GCLK applied to the scan output part 713, and thus, the sixth, eighth, tenth, and twelfth transistors M6, M8, M10, and M12 of the scan output part 713 may be completely turned on. Therefore, in the fourth period t4, the gate clock GCLK having the gate-on voltage level may be output as the scan signal SS having the gate-on voltage level through the eighth transistor M8, and the initialization clock iCLK, the carry clock cCLK, and the sampling clock sCLK having the gate-off voltage level may be respectively output as the initialization control signal ICS, the carry signal CS, and the sampling control signal SCS having the gate-off voltage level through corresponding transistors M6, M10, and M12. At this time, in the fourth period t4, the first node voltage reset part 711*b*, the second node voltage setting part 711*c*, the noise removal part 711*d*, and the second node voltage reset part 711*e* may be maintained in the state which is set in the first period t1.

In the fourth period t4 or after the fourth period t4, when the stage reset signal Vrst having the gate-on voltage level is supplied, the $2-1^{th}$ and $2-2^{th}$ transistors M21 and M22 of the first node voltage reset part 711*b* may be turned on in response to the stage reset signal Vrst having the gate-on voltage level and may reset the voltage of the first node Q to the first low level voltage Vss1. The sixth, eighth, tenth, and twelfth transistors M6, M8, M10, and M12 of the scan output part 713 may be turned off by the first low level voltage Vss1 of the first node Q. Simultaneously, the second node voltage setting part 711*c* may set the voltage of the second node QB to the stage driving voltage Vdd, and thus, the seventh, ninth, eleventh, and thirteenth transistors M7, M9, M11, and M13 of the scan output part 713 connected to the second node Q may be turned on, whereby the first and second low level voltages Vss1 and Vss2 having the gate-off voltage level may be output as the carry signal CS, the scan signal SS, the initialization control signal ICS, and the sampling control signal SCS having the gate-off voltage level through the seventh, ninth, eleventh, and thirteenth transistors M7, M9, M11, and M13 of the scan output part 713. At this time, the $4-1^{th}$ and $4-2^{th}$ transistors M41 and M42 of the noise removal part 711*d* may be turned on with the stage driving voltage Vdd of the second node QB and may supply the first low level voltage Vss1 to the first node Q, thereby removing noise which occurs in the first node Q due to coupling caused by the phase shifts of the clocks cCLK, GCLK, iCLK, and sCLK supplied to the scan output part 713.

As described above, in the $j^{th}$ scan control stage sSTj according to the present embodiment, the current leakage of the first node Q is prevented, and thus, the voltage of the first node Q is stably maintained. Accordingly, an output signal is more stably output, and thus, a range of a threshold voltage for a normal output increases.

Figure 8:
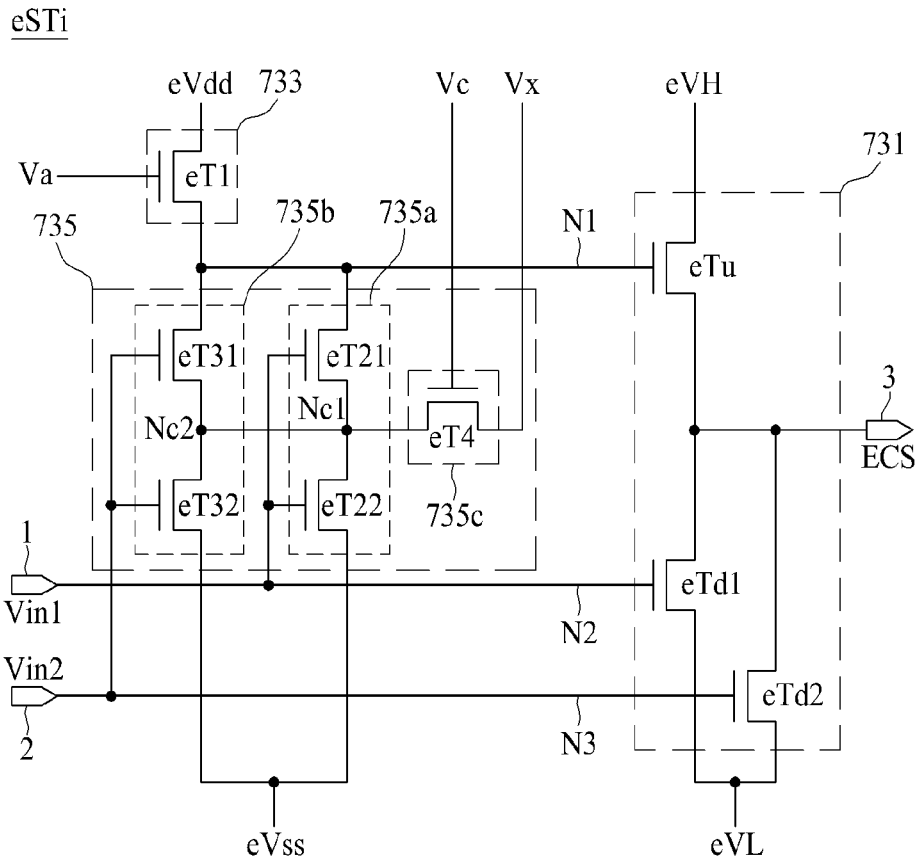
FIG. 8 is a circuit diagram for describing a circuit configuration of an $i^{th}$ emission control stage illustrated in FIG. 4 according to an embodiment of the present disclosure.
Figure 9:
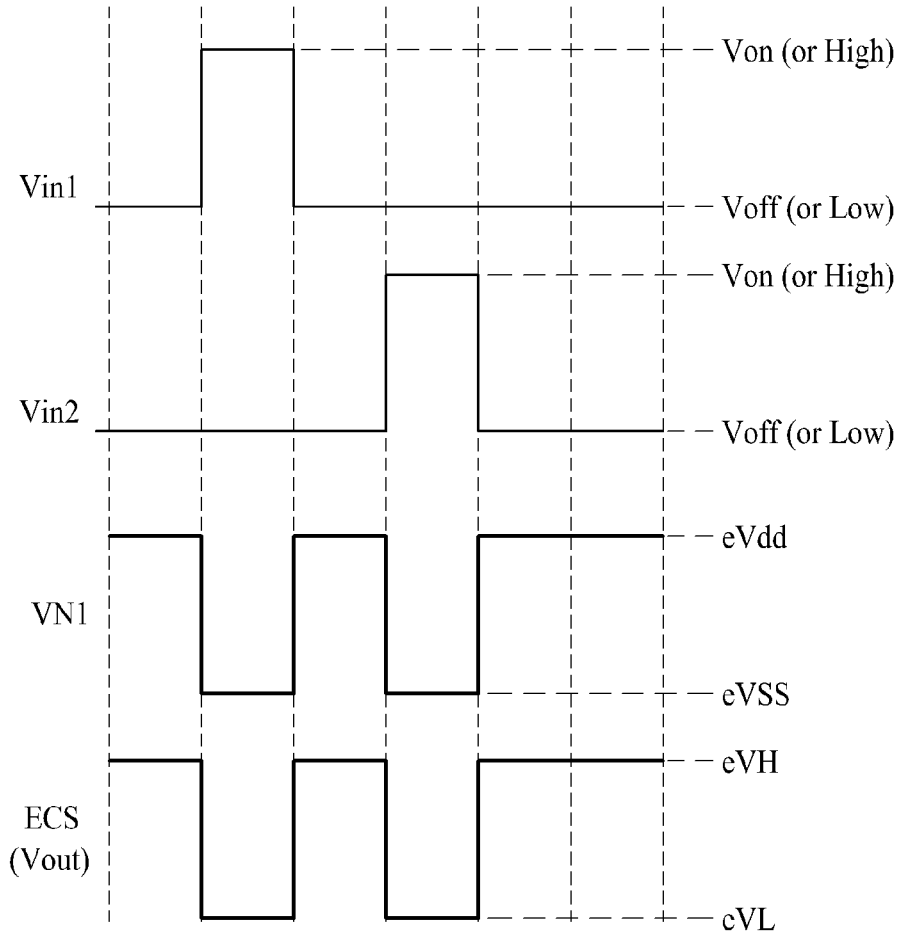
FIG. 9 is a waveform diagram showing a voltage of a first control node and an input/output voltage of the emission control stage illustrated in FIG. 8 according to an embodiment of the present disclosure.

FIG. 8 is a circuit diagram for describing a circuit configuration of the $i^{th}$ emission control stage illustrated in FIG. 4 according to an embodiment of the present disclosure, and FIG. 9 is a waveform diagram showing a voltage of the first control node and an input/output voltage of the emission control stage illustrated in FIG. 8 according to an embodiment of the present disclosure.

Referring to FIGS. 4, 8, and 9, the $i^{th}$ emission control stage sSTi according to an embodiment of the present disclosure may include a first control node N1, a second control node N2, a third control node N3, an output part 731, a node setting part 733, and a node reset part 735.

The first control node N1 may be set to a node driving voltage eVdd according to an operation of the node setting part 733, or may be reset to a node reset voltage eVss according to an operation of the node reset part 735.

The second control node N2 may be connected to a first input terminal 1 and may receive a first input signal Vin1 from a scan control shift register 710. In this case, the first input signal Vin1 may be a carry signal CS output from the $i-a^{th}$ scan control stage sSTj−a of the first to $n^{th}$ scan control stages sST1 to sSTn of the scan control shift register 710. Here, the $i^{th}$ emission control stage sSTi may be disposed closest to the $i^{th}$ scan control stage eSTj. For example, the first input signal Vin1 may be a carry signal CS output from the $j-1^{th}$ scan control stage sSTj−1 of the first to $n^{th}$ scan control stages sST1 to sSTn. The second control node N2 may have a gate-on voltage level or a gate-off voltage level, based on the first input signal Vin1.

The third control node N3 may be connected to a second input terminal 2 and may receive a second input signal Vin2 from the scan control shift register 710. In this case, the second input signal Vin2 may be a carry signal CS output from the $j+b^{th}$ scan control stage sSTj+b of the first to $n^{th}$ scan control stages sST1 to sSTn of the scan control shift register 710. For example, the second input signal Vin2 may be a carry signal CS output from the $j+2^{th}$ scan control stage sSTj+2 of the first to $n^{th}$ scan control stages sST1 to sSTn. The second control node N2 may have the gate-on voltage level Von (or a high logic voltage level High) or the gate-off voltage level (or a low logic voltage level Low), based on the second input signal Vin2.

The output part 731 may output a high level voltage eVH as an emission control signal ECS having the gate-on voltage level or may output a low level voltage eVL as the emission control signal ECS having the gate-off voltage level, based on voltages of the first to third control nodes N1 to N3. For example, the output part 731 may output the emission control signal ECS having a first gate-off voltage level during an initialization period of a pixel P, based on a voltage of the second control node N2 based on the first input signal Vin1 having the gate-on voltage level, and during a data writing period of the pixel P, the output part 731 may output the emission control signal ECS having a second gate-off voltage level, based on a voltage of the third control node N3 based on the second input signal Vin2 having the gate-on voltage level. During a period other than the initialization period and the data writing period of the pixel P in one frame period, the output part 731 may output the emission control signal ECS having the gate-on voltage level, based on the first input signal Vin1 and/or the second input signal Vin2 having the gate-off voltage level.

The output part 721 according to an embodiment may include a pull-up transistor eTu, a first pull-down transistor eTd1, and a second pull-down transistor eTd2.

The pull-up transistor eTu may output a high level voltage eVH to an output terminal 3, based on the voltage of the first control node N1. The pull-up transistor eTu according to an embodiment may include a gate electrode connected to the first control node N1, a source electrode connected to the output terminal 3, and a drain electrode receiving the high level voltage eVH. The pull-up transistor eTu may be turned on/off based on the voltage of the first control node N1, and when the pull-up transistor eTu is turned on, the pull-up transistor eTu may output the high level voltage eVH as the emission control signal ECS having the gate-on voltage level.

The first pull-down transistor eTd1 may output the low level voltage eVL to the output terminal 3, based on the voltage of the second control node N2. The first pull-down transistor eTd1 according to an embodiment may include a gate electrode connected to the second control node N2, a source electrode connected to the output terminal 3, and a drain electrode receiving the low level voltage eVL. The first pull-down transistor eTd1 may be turned on/off based on the voltage of the second control node N2, and when the first pull-down transistor eTd1 is turned on, the first pull-down transistor eTd1 may output the low level voltage eVL as the emission control signal ECS having the gate-off voltage level. For example, the first pull-down transistor eTd1 may output the emission control signal ECS having the first gate-off voltage level during the initialization period of the pixel P.

The second pull-down transistor eTd2 may output the low level voltage eVL to the output terminal 3, based on the voltage of the third control node N3. The second pull-down transistor eTd2 according to an embodiment may include a gate electrode connected to the third control node N3, a source electrode connected to the output terminal 3, and a drain electrode receiving the low level voltage eVL. The second pull-down transistor eTd2 may be turned on/off based on the voltage of the third control node N3, and when the second pull-down transistor eTd2 is turned on, the second pull-down transistor eTd2 may output the low level voltage eVL as the emission control signal ECS having the gate-off voltage level. For example, the second pull-down transistor eTd2 may output the emission control signal ECS having the second gate-off voltage level during the data writing period of the pixel P.

The output part 731 according to the present embodiment may supply the emission control signal ECS having the gate-off voltage level through the first pull-down transistor eTd1 and the second pull-down transistor eTd2 during the data writing period of the pixel P, and thus, deterioration of the first pull-down transistor eTd1 and the second pull-down transistor eTd2 is reduced, thereby increasing the reliability of the emission control signal having the gate-off voltage level.

The node setting part 733 may set the voltage of the first control node N1 to the node driving voltage eVdd. That is, the node setting part 733 may supply the node driving voltage eVdd to the first control node N1 to set the voltage of the first control node N1.

The node setting part 733 according to an embodiment may include a first transistor eT1 which supplies the node driving voltage eVdd to the first control node N1 in response to a direct current (DC) voltage Va. The first transistor eT1 may include a gate electrode supplied with the DC voltage Va, a first source/drain electrode connected to the first control node N1, and a second source/drain electrode supplied with the node driving voltage eVdd.

The node reset part 735 may reset the voltage of the first control node N1 to the node reset voltage eVss, based on the voltage of the second control node N2 and the voltage of the third control node N3. The node reset part 735 according to an embodiment may include a first reset circuit 735*a*, a second reset circuit 735*b*, and a current leakage prevention part 735*c*.

The first reset circuit 735*a* may reset the voltage of the first control node N1 to the node reset voltage eVss in response to the voltage of the second control node N2. The first reset circuit 735*a* according to an embodiment may include $2\text{-}1^{th}$ and $2\text{-}2^{th}$ transistors eT21 and eT22.

The $2\text{-}1^{th}$ and $2\text{-}2^{th}$ transistors eT21 and eT22 may be serially connected between the first control node N1 and a node reset voltage line through which the node reset voltage eVss is supplied, and a first connection node Nc1 may be disposed between the $2\text{-}1^{th}$ and $2\text{-}2^{th}$ transistors eT21 and eT22.

The $2\text{-}1^{th}$ transistor eT21 may include a gate electrode electrically connected to the second control node N2, a first source/drain electrode electrically connected to the first connection node Nc1, and a second source/drain electrode electrically connected to the first control node N1.

The $2\text{-}2^{th}$ transistor eT22 may include a gate electrode electrically connected to the second control node N2, a first source/drain electrode electrically connected to the node reset voltage line, and a second source/drain electrode electrically connected to the first connection node Nc1.

The $2\text{-}1^{th}$ and $2\text{-}2^{th}$ transistors eT21 and eT22 may be simultaneously turned on/off with the voltage of the second control node N2, and when the $2\text{-}1^{th}$ and $2\text{-}2^{th}$ transistors eT21 and eT22 are simultaneously turned on, the $2\text{-}1^{th}$ and $2\text{-}2^{th}$ transistors eT21 and eT22 may reset the voltage of the first control node N1 to the node reset voltage eVss. That is, the $2\text{-}1^{th}$ and $2\text{-}2^{th}$ transistors eT21 and eT22 may be simultaneously turned on according to the first input signal Vin1 having the gate-on voltage level supplied to the second control node N2 and may supply the node reset voltage eVss to the first control node N1, thereby discharging the voltage of the first control node N1 to the node reset voltage eVss.

The first connection node Nc1 between the $2\text{-}1^{th}$ and $2\text{-}2^{th}$ transistors eT21 and eT22 provided in the first reset circuit 735*a* may be shared by the second reset circuit 735*a*.

The second reset circuit 735*b* may reset the voltage of the first control node N1 to the node reset voltage eVss in response to the voltage of the third control node N3. The second reset circuit 735*b* according to an embodiment may include $3\text{-}1^{th}$ and $3\text{-}2^{th}$ transistors eT31 and eT32.

The $3\text{-}1^{th}$ and $3\text{-}2^{th}$ transistors eT31 and eT32 may be serially connected between the first control node N1 and the node reset voltage line, and a second connection node Nc2 electrically connected to the first connection node Nc1 of the first reset circuit 735*a* may be disposed between the $3\text{-}1^{th}$ and $3\text{-}2^{th}$ transistors eT31 and eT32.

The $3\text{-}1^{th}$ transistor eT31 may include a gate electrode electrically connected to the third control node N3, a first source/drain electrode electrically connected to the second connection node Nc2, and a second source/drain electrode electrically connected to the first control node N1.

The $3\text{-}2^{th}$ transistor eT32 may include a gate electrode electrically connected to the third control node N3, a first source/drain electrode electrically connected to the node reset voltage line, and a second source/drain electrode electrically connected to the second connection node Nc2.

The $3\text{-}1^{th}$ and $3\text{-}2^{th}$ transistors eT31 and eT32 may be simultaneously turned on/off with the voltage of the third control node N3, and when the $3\text{-}1^{th}$ and $3\text{-}2^{th}$ transistors eT31 and eT32 are simultaneously turned on, the $3\text{-}1^{th}$ and $3\text{-}2^{th}$ transistors eT31 and eT32 may reset the voltage of the first control node N1 to the node reset voltage eVss. That is, the $3\text{-}1^{th}$ and $3\text{-}2^{th}$ transistors eT31 and eT32 may be simultaneously turned on according to the second input signal Vin2 having the gate-on voltage level supplied to the third control node N3 and may supply the node reset voltage eVss to the first control node N1, thereby discharging the voltage of the first control node N1 to the node reset voltage eVss.

The current leakage prevention part 735*c* may supply a current leakage prevention voltage Vx to the first connection node Nc1, based on a control voltage Vc. That is, the current leakage prevention part 735*c* may supply the current leakage prevention voltage Vx to the first connection node Nc1 of the first reset circuit 735*a* and the second connection node Nc2 of the second reset circuit 735*b*, based on the control voltage Vc, and thus, when the first reset circuit 735*a* and the second reset circuit 735*b* are turned off, the current leakage prevention part 735*c* may completely turn off the first reset circuit 735*a* and the second reset circuit 735*b*, thereby preventing the current leakage of the first control node N1.

The current leakage prevention part 735*c* may include a fourth transistor eT4 which is turned on with the control voltage Vc and supplies the current leakage prevention voltage Vx to the first connection node Nc1. The fourth transistor eT4 may include a gate electrode supplied with the control voltage Vc, a first source/drain electrode supplied with the current leakage prevention voltage Vx, and a second source/drain electrode connected to the first connection node Nc1. When the 2–1$^{th}$ and 2–2$^{th}$ transistors eT21 and eT22 of the first reset circuit 735*a* and/or the 3–1$^{th}$ and 3–2$^{th}$ transistors eT31 and eT32 of the second reset circuit 735*b* are turned off, the fourth transistor eT4 may supply the current leakage prevention voltage Vx to the first connection node Nc1 of the first reset circuit 735*a* and the second connection node Nc2 of the second reset circuit 735*b*, based on the control voltage Vc to completely turn off the 2–1$^{th}$ transistor eT21 of the first reset circuit 735*a* and/or the 3–1$^{th}$ transistor eT31 of the second reset circuit 735*b*, thereby preventing the current leakage of the first node Q. That is, in the 2–1$^{th}$ transistor eT21 of the first reset circuit 735*a* and/or the 3–1$^{th}$ transistor eT31 of the second reset circuit 735*b*, a source voltage may be higher than a gate voltage due to the current leakage prevention voltage Vx in a turn-off state, and thus, a complete turn-off state may be maintained.

The emission control stage eSTi according to the present embodiment may output the emission control signal ECS according to the first and second input signals which differ, and thus, may have a simplified circuit configuration. Also, the current leakage of the first control node N1 is prevented by the current leakage prevention part 735*c*, and thus, the emission control stage eSTi may normally output the emission control signal ECS, thereby increasing the reliability of the emission control signal ECS.

The transistors eT1 to eT4, eTu, and eTd configuring each of the first to n$^{th}$ emission control stages eST1 to eSTm of the emission control shift register according to the present embodiment may be an N-type TFT or a P-type TFT, which includes a semiconductor layer including an oxide semiconductor material, single crystalline silicon, polycrystalline silicon, or an organic material.

Figure 10A:
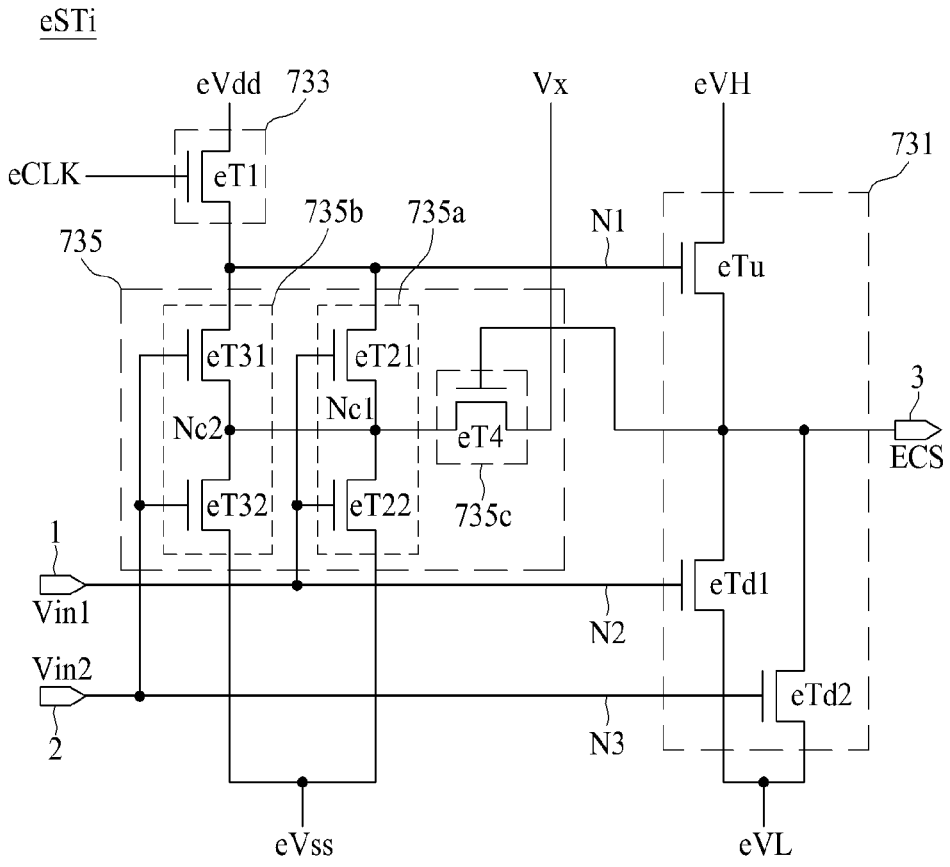
FIGS. 10A to 10C are diagrams for describing modification embodiments of the emission control stage illustrated in FIG. 8 according to an embodiment of the present disclosure.
Figure 10B:
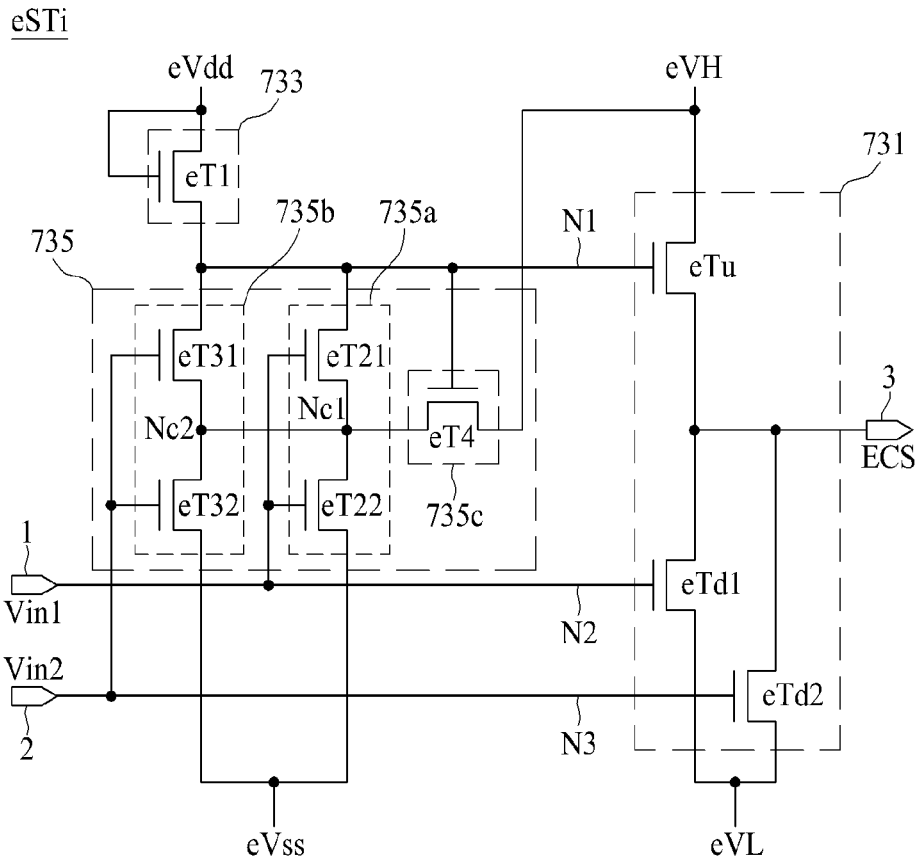
Figure 10C:
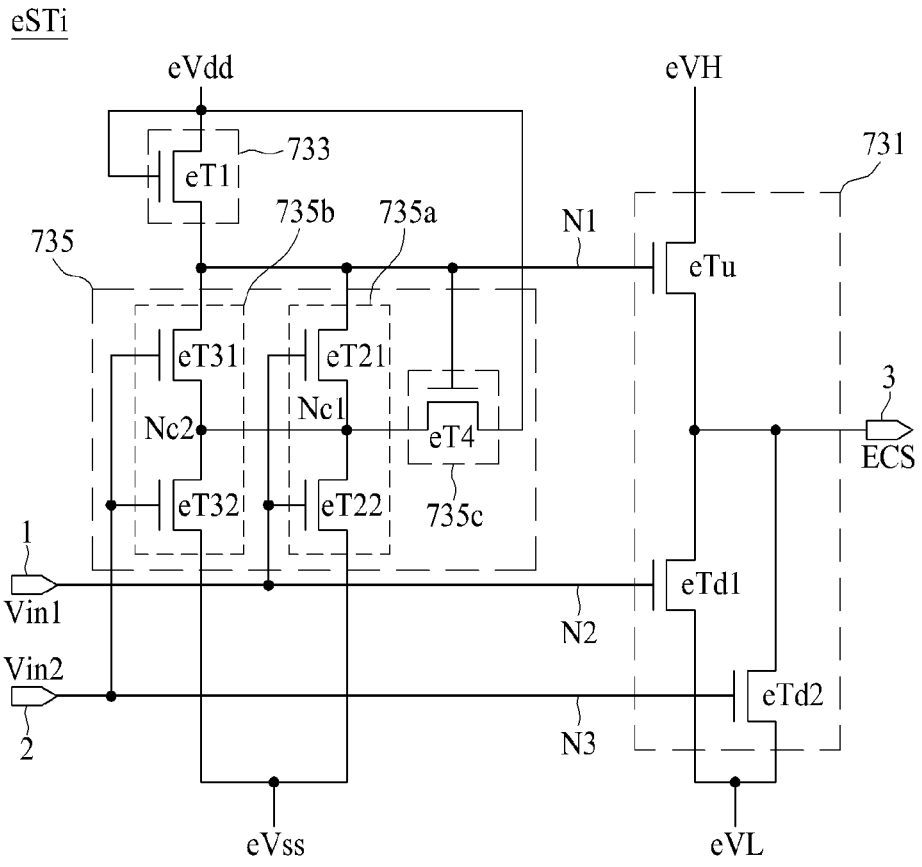

FIGS. 10A to 10C are diagrams for describing modification embodiments of the emission control stage illustrated in FIG. 8 according to an embodiment of the present disclosure.

First, referring to FIG. 10A, except for that an emission clock eCLK is supplied as a control signal for a node setting part 733 and an output of an output part 731 is supplied as a control signal for a current leakage prevention part 735*c*, an emission control stage eSTi according to a modification embodiment of the present disclosure is the same as the emission control stage illustrated in FIG. 8, and thus, overlapping descriptions of the same elements other than the emission clock eCLK and the current leakage prevention part 735*c* are omitted.

The node setting part 733 may set a voltage of a first control node N1 to a node driving voltage eVdd, based on an emission clock eCLK. The node setting part 733 according to an embodiment may include a first transistor eT1 which is turned on/off based on the emission clock eCLK, and when the first transistor eT1 is turned on, supplies the node driving voltage eVdd to the first control node N1.

The emission clock eCLK may have the same phase as that of the emission control signal ECS illustrated in FIG. 3 or 9. In this case, the timing controller of the light emitting display apparatus according to the present disclosure may generate a plurality of emission clocks and may supply the plurality of emission clocks to the gate driving circuit. For example, the timing controller may generate first to sixth emission clocks. In this case, a k$^{th}$ (where k is a natural number from one to six) emission clock of the first to sixth emission clocks may be supplied to a 6x–y$^{th}$ (where x is a natural number, and y is a natural number "6–k") scan control stage sST6*x*–*y*.

The current leakage prevention part 735*c* may supply a current leakage prevention voltage Vx to a first connection node Nc1 of a first reset circuit 735*a* and a second connection node Nc2 of a second reset circuit 735*b* according to the emission control signal ECS output to an output terminal 3 of the output part 731, and thus, when the first reset circuit 735*a* and the second reset circuit 735*b* are turned off, the current leakage prevention part 735*c* may completely turn off the first reset circuit 735*a* and the second reset circuit 735*b*, thereby preventing the current leakage of the first control node N1. In this case, a gate electrode of a fourth transistor eT4 included in the current leakage prevention part 735*c* may be electrically connected to the output terminal 3 of the output part 731.

Optionally, the current leakage prevention part 735*c* may supply the current leakage prevention voltage Vx to the first connection node Nc1 of the first reset circuit 735*a* and the second connection node Nc2 of the second reset circuit 735*b*, based on the voltage of the first control node N1, and thus, when the first reset circuit 735*a* and the second reset circuit 735*b* are turned off, the current leakage prevention part 735*c* may completely turn off the first reset circuit 735*a* and the second reset circuit 735*b*, thereby preventing the current leakage of the first control node N1. In this case, the gate electrode of the fourth transistor eT4 included in the current leakage prevention part 735*c* may be electrically connected to the first control node N1.

As described above, in the emission control stage eSTi according to a modification embodiment of the present disclosure, the node driving voltage eVdd may be charged into the first control node N1, based on the emission clock eCLK having a gate-on voltage level, and thus, deterioration of a pull-up transistor eTu caused by the voltage of the first control node N1 is reduced. Also, by using the emission control signal ECS output to the output terminal 3 or the voltage of the control node N1 as a control signal for the current leakage prevention part 735*c*, a separate control voltage for controlling the current leakage prevention part 735*c* is not needed, and thus, a configuration of a circuit is simplified.

Referring to FIG. 10B, except for that a node driving voltage eVdd is supplied as a control signal for a node setting part 733, a voltage of a first control node N1 is supplied as a control signal for a current leakage prevention part 735*c*, and a high level voltage eVH is uses as a current leakage prevention voltage, an emission control stage eSTi according to another modification embodiment of the present disclosure is the same as the emission control stage illustrated in FIG. 8, and thus, overlapping descriptions of the same elements other than the node driving voltage eVdd and the current leakage prevention part 735*c* are omitted.

The node setting part 733 may set a voltage of a first control node N1 to a node driving voltage eVdd. The node setting part 733 according to an embodiment may include a first transistor eT1 which is turned on/off based on the node driving voltage eVdd, and when the first transistor eT1 is turned on, supplies the node driving voltage eVdd to the first control node N1. The first transistor eT1 may be diode-connected to a node driving voltage line through which the node driving voltage eVdd is supplied.

The current leakage prevention part 735*c* may supply the high level voltage eVH to a first connection node Nc1 of a first reset circuit 735*a* and a second connection node Nc2 of a second reset circuit 735*b*, based on a voltage of the first control node N1, and thus, when the first reset circuit 735*a* and the second reset circuit 735*b* are turned off, the current leakage prevention part 735*c* may completely turn off the first reset circuit 735*a* and the second reset circuit 735*b*, thereby preventing the current leakage of the first control node N1. In this case, a fourth transistor eT4 included in the current leakage prevention part 735*c* may include a gate electrode electrically connected to the first control node N1, a first source/drain electrode supplied with the high level voltage eVH, and a second source/drain electrode connected to the first connection node Nc1.

Optionally, the current leakage prevention part 735*c* may supply the high level voltage eVH to the first connection node Nc1 of the first reset circuit 735*a* and the second connection node Nc2 of the second reset circuit 735*b* according to an emission control signal ECS output to an output terminal 3 of an output part 731, and thus, when the first reset circuit 735*a* and the second reset circuit 735*b* are turned off, the current leakage prevention part 735*c* may completely turn off the first reset circuit 735*a* and the second reset circuit 735*b*, thereby preventing the current leakage of the first control node N1. In this case, the fourth transistor eT4 of the current leakage prevention part 735*c* may include a gate electrode electrically connected to the output terminal 3 of the output part 731, a first source/drain electrode supplied with the high level voltage eVH, and a second source/drain electrode connected to the first connection node Nc1.

In the present embodiment, as illustrated in FIG. 10C, the current leakage prevention part 735*c* may use the node driving voltage eVdd as a current leakage prevention voltage, instead of the high level voltage eVH. As a result, the fourth transistor eT4 of the current leakage prevention part 735*c* may be turned on/off based on a control voltage Vc, a voltage of the first control node, or an output voltage of the output part 731. Also, when the fourth transistor eT4 of the current leakage prevention part 735*c* is turned on, the fourth transistor eT4 may supply a current leakage prevention voltage Vx, the high level voltage eVH, or the node driving voltage eVdd to a first connection node Nc1 of a first reset circuit 735*a* and a second connection node Nc2 of a second reset circuit 735*b*.

As described above, in the emission control stage eSTi according to another modification embodiment of the present disclosure, the node driving voltage eVdd may be charged into the first control node N1, and thus, a signal such as a separate DC voltage or emission clock for controlling the node setting part 733 is not needed. Also, by using the emission control signal ECS output to the output terminal 3 or the voltage of the first control node N1 as a control signal for the current leakage prevention part 735*c* and by using the high level voltage eVH or the node driving voltage eVdd as a current leakage prevention voltage, a separate control voltage and driving voltage for controlling and driving the current leakage prevention part 735*c* is not needed, and thus, a configuration of a circuit is simplified.

Figure 11:
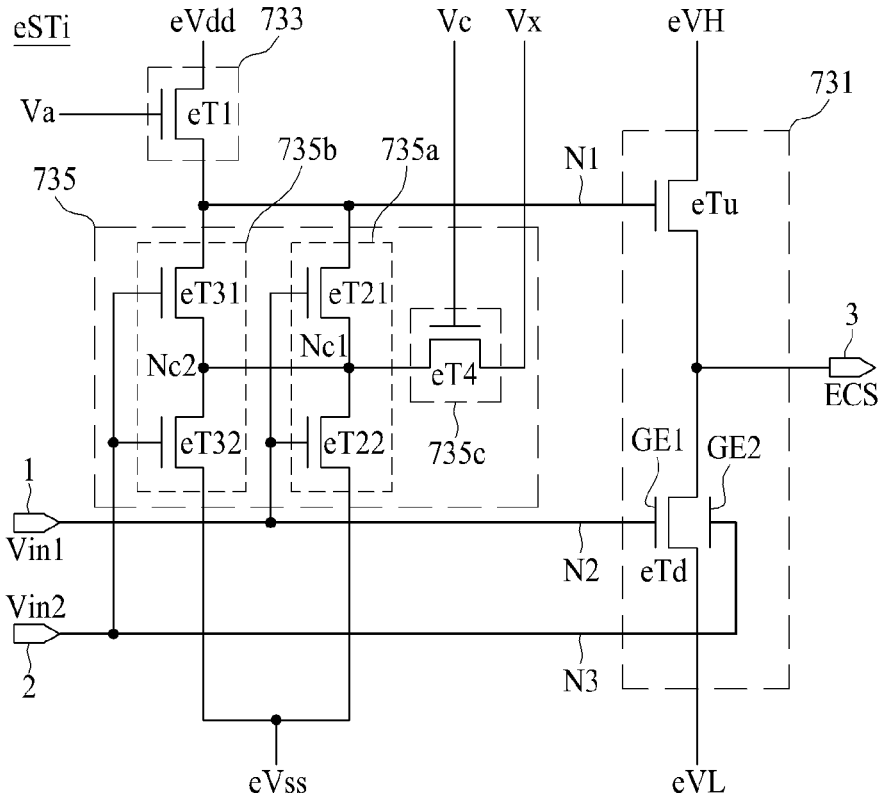
FIG. 11 is a circuit diagram for describing a circuit configuration of an $i^{th}$ emission control stage illustrated in FIG. 4, according to another embodiment of the present disclosure.

FIG. 11 is a circuit diagram for describing a circuit configuration of an $i^{th}$ emission control stage illustrated in FIG. 4, according to another embodiment of the present disclosure and is implemented by modifying a configuration of an output part in the emission control stage illustrated in FIG. 8. Hereinafter, therefore, only an output part and elements relevant thereto will be described, and overlapping descriptions of the other elements are omitted.

Referring to FIG. 11, in an emission control stage eSTi according to the present embodiment, an output part 731 may output a high level voltage eVH as an emission control signal ECS having a gate-on voltage level or may output a low level voltage eVL as the emission control signal ECS having a gate-off voltage level, based on voltages of first to third control nodes N1, N2 and N3. The output part 731 according to the present embodiment may include a pull-up transistor eTu and a pull-down transistor eTd having a double gate structure.

The pull-up transistor eTu may output the high level voltage eVH to an output terminal 3, based on the voltage of the first control node N1. The pull-up transistor eTu according to an embodiment may include a gate electrode connected to the first control node N1, a source electrode connected to the output terminal 3, and a drain electrode supplied with the high level voltage eVH. The pull-up transistor eTu may be turned on/off based on the voltage of the first control node N1, and when the pull-up transistor eTu is turned on, the pull-up transistor eTu may output the high level voltage eVH as the emission control signal ECS having the gate-on voltage level.

The pull-down transistor eTd may output the low level voltage eVL as the emission control signal ECS having the gate-off voltage level, based on the voltages of second and third control nodes N2 and N3.

The pull-down transistor eTd may include a bottom gate electrode GE1 electrically connected to one of the second control node N2 and the third control node N3, a top gate electrode GE2 electrically connected to the other control node of the second control node N2 and the third control node N3, a first source/drain electrode electrically connected to the output terminal 3, and a second source/drain electrode electrically connected to a low level voltage line through which the low level voltage eVL is supplied. For example, the bottom gate electrode GE1 of the pull-down transistor eTd may be electrically connected to the second control node N2, and the top gate electrode GE2 of the pull-down transistor eTd may be electrically connected to the third control node N3. The pull-down transistor eTd may be turned on by the voltage of the second control node N2 based on a first input signal Vin1 having the gate-on voltage level or the voltage of the third control node N3 based on a second input signal Vin2 having the gate-on voltage level and may be turned off by the voltage of the second control node N2 based on the first input signal Vin1 having the gate-off voltage level and the voltage of the third control node N3 based on the second input signal Vin2 having the gate-off voltage level.

As described above, the emission control stage eSTi according to another embodiment of the present disclosure has the same effect as that of the emission control stage illustrated in FIG. 8, and by using the pull-down transistor eTd having the double gate structure, a circuit configuration of the output part 731 is simplified and a circuit area are reduced, thereby decreasing a bezel width of the emission control apparatus.

Moreover, the node setting part 733 of the emission control stage eSTi according to another embodiment of the present disclosure may be modified to have the same circuit structure as that of the node setting part illustrated in FIGS. 10A to 10C, and the current leakage prevention part 735*c* of the emission control stage eSTi according to another embodiment of the present disclosure may be modified to have the same circuit structure as that of the current leakage prevention part illustrated in FIGS. 10A to 10C.

Figure 12:
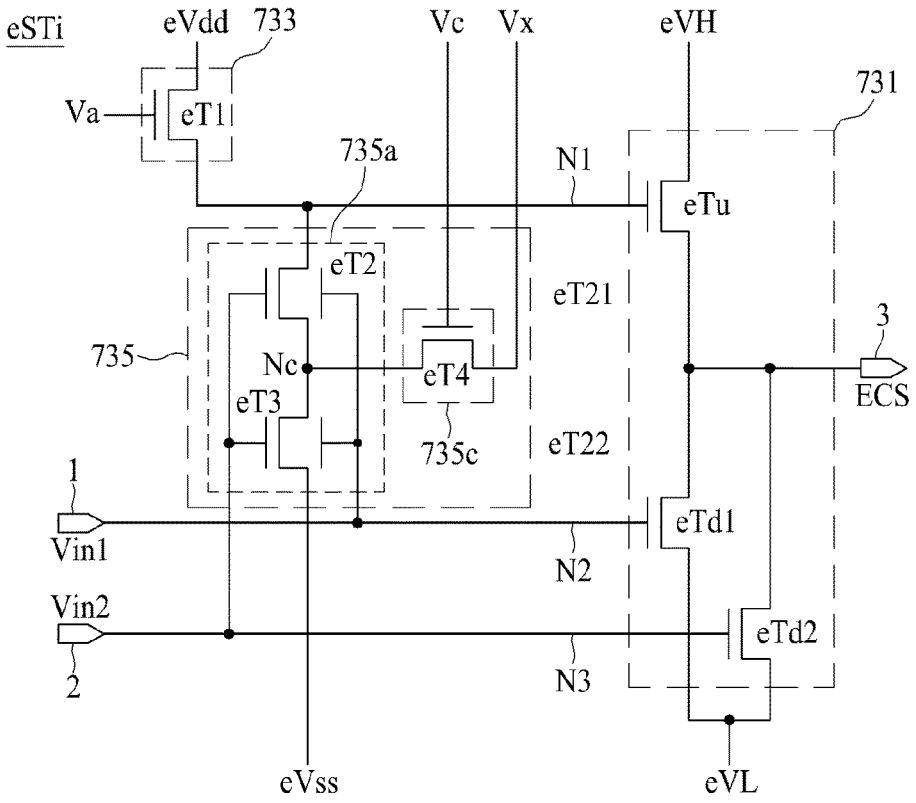
FIG. 12 is a circuit diagram for describing a circuit configuration of an $i^{th}$ emission control stage illustrated in FIG. 4, according to another embodiment of the present disclosure.

FIG. 12 is a circuit diagram for describing a circuit configuration of an emission control stage illustrated in FIG. 4, according to another embodiment of the present disclosure and is implemented by modifying a configuration of a node reset part in the emission control stage illustrated in FIG. 8. Hereinafter, therefore, only a node reset part and elements relevant thereto will be described, and overlapping descriptions of the other elements are omitted.

Referring to FIG. 12, in an emission control stage eSTi according to the present embodiment, a node reset part 735 may reset a voltage of a first control node N1 to a node reset voltage eVss, based on a voltage of a second control node N2 and a voltage of a third control node N3. The node reset part 735 according to the present embodiment may include a reset circuit 735*a* and a current leakage prevention part 735*c*.

The reset circuit 735*a* may reset the voltage of the first control node N1 to the node reset voltage eVss in response to the voltage of the second control node N2 and the voltage of the third control node N3. The reset circuit 735*a* according to an embodiment may include second and third transistors sT2 and eT3 having a double gate structure.

The second and third transistors sT2 and eT3 may be serially connected between the first control node N1 and a node reset voltage line through which the node reset voltage eVss is supplied, and a connection node Nc may be disposed between the second and third transistors sT2 and eT3.

The second transistor eT2 according to an embodiment may include a bottom gate electrode electrically connected to one of the second control node N2 and the third control node N3, a top gate electrode electrically connected to the other control node of the second control node N2 and the third control node N3, a first source/drain electrode electrically connected to the connection node Nc, and a second source/drain electrode electrically connected to the first control node N1. For example, the bottom gate electrode of the second transistor eT2 may be electrically connected to the second control node N2, and the top gate electrode of the second transistor eT2 may be electrically connected to the third control node N3. The second transistor eT2 may be turned on by the voltage of the second control node N2 based on a first input signal Vin1 having a gate-on voltage level or the voltage of the third control node N3 based on a second input signal Vin2 having the gate-on voltage level and may be turned off by the voltage of the second control node N2 based on the first input signal Vin1 having a gate-off voltage level and the voltage of the third control node N3 based on the second input signal Vin2 having the gate-off voltage level.

The third transistor eT3 according to an embodiment may include a bottom gate electrode electrically connected to the bottom gate electrode of the second transistor eT2, a top gate electrode electrically connected to the top gate electrode of the second transistor eT2, a first source/drain electrode electrically connected to the node reset voltage line, and a second source/drain electrode electrically connected to the connection node Nc. The third transistor eT3 may be turned on by the voltage of the second control node N2 based on the first input signal Vin1 having the gate-on voltage level or the voltage of the third control node N3 based on a second input signal Vin2 having the gate-on voltage level and may be turned off by the voltage of the second control node N2 based on the first input signal Vin1 having the gate-off voltage level and the voltage of the third control node N3 based on the second input signal Vin2 having the gate-off voltage level.

The current leakage prevention part 735*c* may supply a current leakage prevention voltage Vx to the connection node Nc, based on a control voltage Vc. The current leakage prevention part 735*c* according to an embodiment may include a fourth transistor eT4 which is turned on with the control voltage Vc and supplies the current leakage prevention voltage Vx to the connection node Nc.

The fourth transistor eT4 may include a gate electrode supplied with the control voltage Vc, a first source/drain electrode supplied with the current leakage prevention voltage Vx, and a second source/drain electrode connected to the connection node Nc. When the second and third transistors eT2 and eT3 of the reset circuit 735*a* are turned off, the fourth transistor eT4 may supply the current leakage prevention voltage Vx to the connection node Nc of the reset circuit 735*a* to completely turn off the second transistor eT2, thereby preventing the current leakage of the first control node N1.

As described above, the emission control stage eSTi according to another embodiment of the present disclosure has the same effect as that of the emission control stage illustrated in FIG. 8, and by using the second and third transistors eT2 and eT3 having the double gate structure, a circuit configuration of the reset circuit 735*a* of the node setting part 735 is simplified and a circuit area are reduced, thereby decreasing a bezel width of the emission control apparatus.

Moreover, the node setting part 733 of the emission control stage eSTi according to another embodiment of the present disclosure may be modified to have the same circuit structure as that of the node setting part illustrated in FIGS. 10A to 10C, and the current leakage prevention part 735*c* of the emission control stage eSTi according to another embodiment of the present disclosure may be modified to have the same circuit structure as that of the current leakage prevention part illustrated in FIGS. 10A to 10C. Also, in the emission control stage eSTi according to another embodiment of the present disclosure, first and second pull-down transistors eTd1 and eTd2 of an output part 731 may be replaced by one pull-down transistor having the double gate structure illustrated in FIG. 11.

Figure 13:
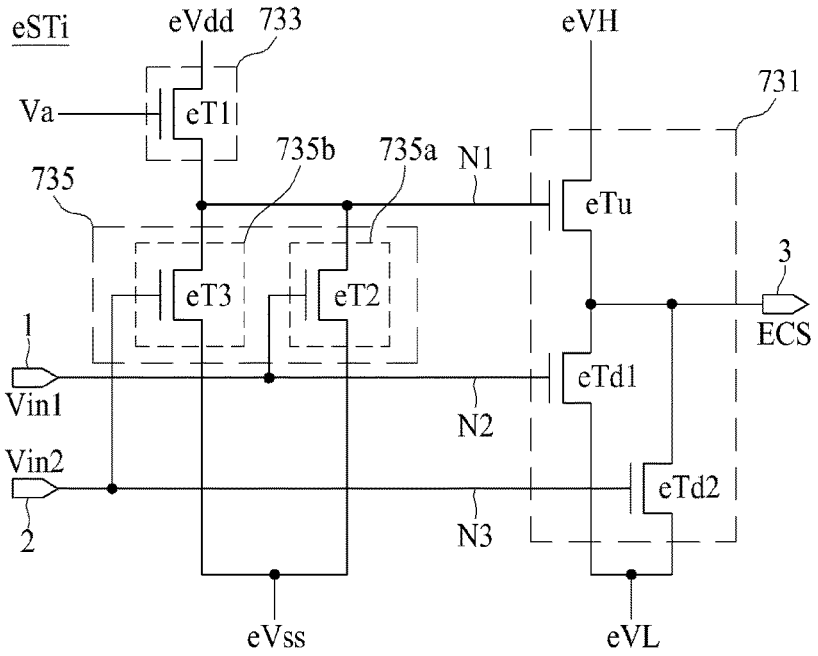
FIG. 13 is a circuit diagram for describing a circuit configuration of an $i^{th}$ emission control stage illustrated in FIG. 4, according to another embodiment of the present disclosure.

FIG. 13 is a circuit diagram for describing a circuit configuration of an emission control stage illustrated in FIG. 4, according to another embodiment of the present disclosure and is implemented by modifying a configuration of a node reset part in the emission control stage illustrated in FIG. 8. Hereinafter, therefore, only a node reset part and elements relevant thereto will be described, and overlapping descriptions of the other elements are omitted.

Referring to FIG. 13, in an emission control stage eSTi according to the present embodiment, a node reset part 735 may reset a voltage of a first control node N1 to a node reset voltage eVss, based on a voltage of a second control node N2 and a voltage of a third control node N3. In this case, the node reset voltage eVss may have a voltage level which is higher than the gate-off voltage level of each of a first input signal Vin1 supplied to the second control node N2 and a second input signal Vin2 supplied to the third control node N3.

The node reset part 735 according to the present embodiment may include a first reset circuit 735*a* and a second reset circuit 735*b*.

The first reset circuit 735*a* may reset a voltage of the first control node N1 to the node reset voltage eVss in response to the voltage of the second control node N2 based on a first input signal Vin1. The first reset circuit 735*a* according to an embodiment may include a second transistor eT2. The second transistor eT2 may include a gate electrode electrically connected to the second control node N2, a first source/drain electrode electrically connected to a node reset voltage line through which the node reset voltage eVss is supplied, and a second source/drain electrode electrically connected to the first control node N1. The second transistor eT2 may be turned on based on the voltage of the second control node N2 and may electrically connect the first control node N1 to the node reset voltage line. For example, the second transistor eT2 may be turned on by the voltage of the second control node N2 based on a first input signal Vin1 having a gate-on voltage level to reset the voltage of the first control node N1 to a node reset voltage eVss and may be turned off by the voltage of the second control node N2 based on the first input signal Vin1 having a gate-off voltage level. At this time, when the second transistor eT2 is turned off, a source voltage of the second transistor eT2 may have a voltage level which is higher than the gate-off voltage level of the first input signal Vin1, based on the node reset voltage eVss, and thus, the second transistor eT2 may be completely turned off.

The second reset circuit 735*b* may reset the voltage of the first control node N1 to the node reset voltage eVss in response to the voltage of the third control node N3 based on a second input signal Vin2. The second reset circuit 735*b* according to an embodiment may include a third transistor eT3. The third transistor eT3 may include a gate electrode electrically connected to the third control node N3, a first source/drain electrode electrically connected to the node reset voltage line through which the node reset voltage eVss is supplied, and a second source/drain electrode electrically connected to the first control node N1. The third transistor eT3 may be turned on by the voltage of the third control node N3 based on the second input signal Vin2 to reset the voltage of the first control node N1 to the node reset voltage eVss and may be turned off by the voltage of the third control node N3 based on the second input signal Vin2 having the gate-off voltage level. At this time, when the third transistor eT3 is turned off, a source voltage of the third transistor eT3 may have a voltage level which is higher than the gate-off voltage level of the second input signal Vin2, based on the node reset voltage eVss, and thus, the third transistor eT3 may be completely turned off.

As described above, the emission control stage eSTi according to another embodiment of the present disclosure may output the emission control signal ECS according to the first and second input signals Vin1 and Vin2 which differ, and thus, may have a simplified circuit configuration. Also, since the node reset voltage eVss supplied to the node reset part 735 has a voltage level which is higher than the gate-off voltage level of each of the first and second input signals Vin1 and Vin2, the current leakage of the first control node N1 is prevented, and thus, the emission control signal is normally output, thereby increasing the reliability of the emission control signal and simplifying a configuration of a circuit.

Moreover, the node setting part 733 of the emission control stage eSTi according to another embodiment of the present disclosure may be modified to have the same circuit structure as that of the node setting part illustrated in FIGS. 10A and 10B. Also, in the emission control stage eSTi according to another embodiment of the present disclosure, first and second pull-down transistors eTd1 and eTd2 of an output part 731 may be replaced by one pull-down transistor having the double gate structure illustrated in FIG. 11.

Figure 14:
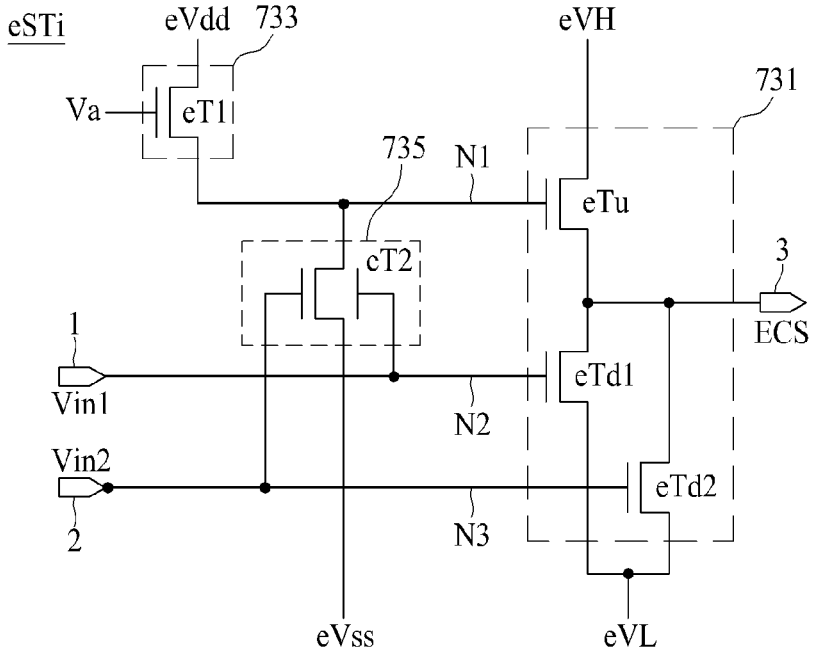
FIG. 14 is a circuit diagram for describing a circuit configuration of an emission control stage illustrated in FIG. 4, according to another embodiment of the present disclosure.

FIG. 14 is a circuit diagram for describing a circuit configuration of an emission control stage illustrated in FIG. 4, according to another embodiment of the present disclosure and is implemented by modifying a configuration of a node reset part in the emission control stage illustrated in FIG. 13. Hereinafter, therefore, only a node reset part and elements relevant thereto will be described, and overlapping descriptions of the other elements are omitted.

Referring to FIG. 14, in an emission control stage eSTi according to the present embodiment, a node reset part 735 may reset a voltage of a first control node N1 to a node reset voltage eVss, based on a voltage of a second control node N2 and a voltage of a third control node N3. In this case, the node reset voltage eVss may have a voltage level which is higher than the gate-off voltage level of each of a first input signal Vin1 supplied to the second control node N2 and a second input signal Vin2 supplied to the third control node N3.

The node reset part 735 according to the present embodiment may include a second transistor eT2 having a double gate structure.

The second transistor eT2 according to an embodiment may include a bottom gate electrode electrically connected to one of the second control node N2 and the third control node N3, a top gate electrode electrically connected to the other control node of the second control node N2 and the third control node N3, a first source/drain electrode electrically connected to a node reset voltage line through which a node reset voltage eVss is supplied, and a second source/drain electrode electrically connected to the first control node N1. For example, the bottom gate electrode of the second transistor eT2 may be electrically connected to the second control node N2, and the top gate electrode of the second transistor eT2 may be electrically connected to the third control node N3.

The second transistor eT2 may be turned on by the voltage of the second control node N2 based on the first input signal Vin1 having a gate-on voltage level or the voltage of the third control node N3 based on the second input signal Vin2 having the gate-on voltage level to reset the voltage of the first control node N1 to a node reset voltage eVss and may be turned off by the voltage of the second control node N2 based on the first input signal Vin1 having the gate-off voltage level and the voltage of the third control node N3 based on the second input signal Vin2 having the gate-off voltage level. At this time, when the second transistor eT2 is turned off, a source voltage of the second transistor eT2 may have a voltage level which is higher than the gate-off voltage level of the first input signal Vin1, based on the node reset voltage eVss, and thus, the second transistor eT2 may be completely turned off.

As described above, the emission control stage eSTi according to another embodiment of the present disclosure has the same effect as that of the emission control stage illustrated in FIG. 13, and by using the second transistor eT2 having the double gate structure, a circuit configuration of the node setting part 735 is more simplified and a circuit area are reduced, thereby decreasing a bezel width of the emission control apparatus.

Moreover, the node setting part 733 of the emission control stage eSTi according to another embodiment of the present disclosure may be modified to have the same circuit structure as that of the node setting part illustrated in FIGS. 10A and 10B. Also, in the emission control stage eSTi according to another embodiment of the present disclosure, first and second pull-down transistors eTd1 and eTd2 of an output part 731 may be replaced by one pull-down transistor having the double gate structure illustrated in FIG. 11.

Figure 15:
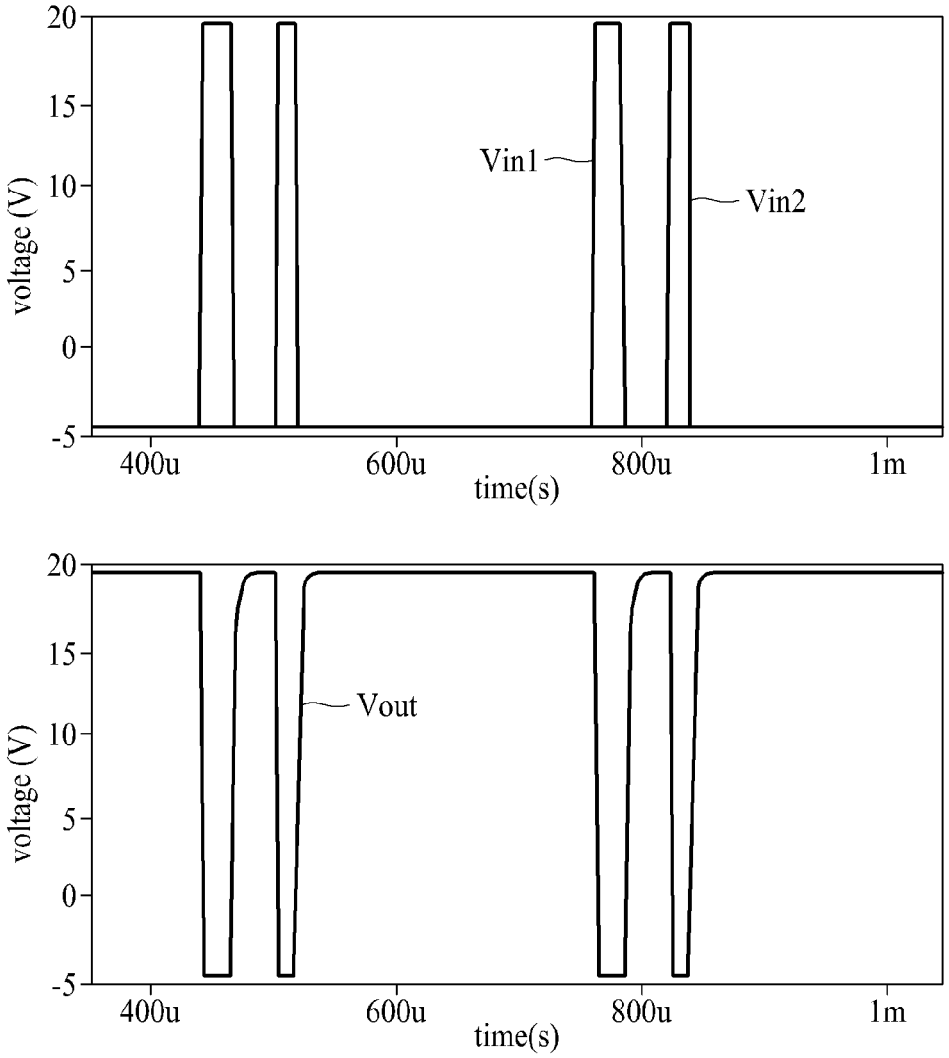
FIG. 15 is a simulation waveform diagram showing an input/output waveform of an emission control stage according to an embodiment of the present disclosure illustrated in FIG. 10B.

FIG. 15 is a simulation waveform diagram showing an input/output waveform of the emission control stage according to an embodiment of the present disclosure illustrated in FIG. 10B. FIG. 15 shows a result of a simulation performed when a threshold voltage Vth of a transistor is 1 V, under a condition where eVdd is 20 V, eVH is 20 V, eVL is −5 V, eVss is −5 V, and each of Vin1 and Vin2 is −5 V to 20 V in FIG. 10B.

As shown in FIG. 15, it may be seen that an output waveform Vout of the emission control stage is changed by the first and second input signals Vin1 and Vin2, and particularly, it may be confirmed that when all of the first and second input signals Vin1 and Vin2 are a low voltage of −5 V, a high voltage of 20 V is output.

Figure 16A:
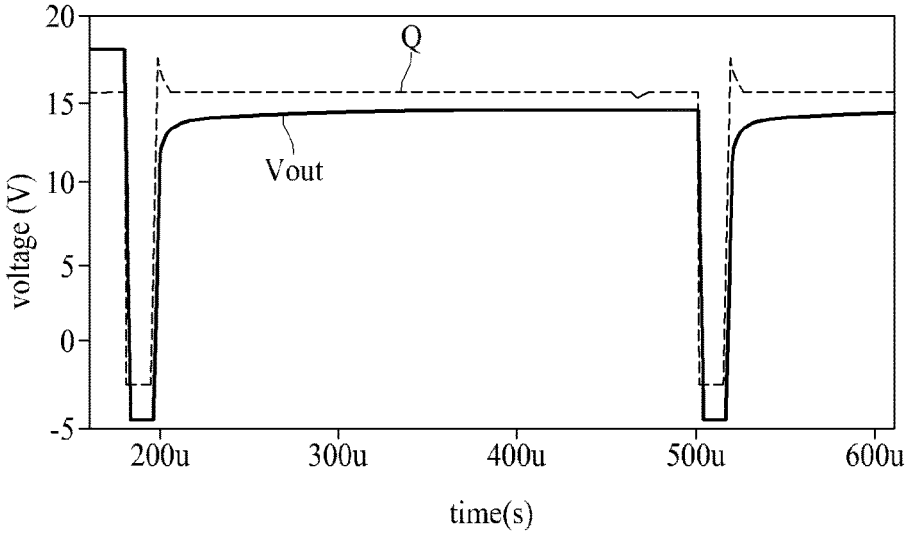
FIGS. 16A and 16B are simulation waveform diagrams showing an output waveform and a voltage of a control node of an emission control stage according to each of a comparative example and an embodiment of the present disclosure.
Figure 16B:
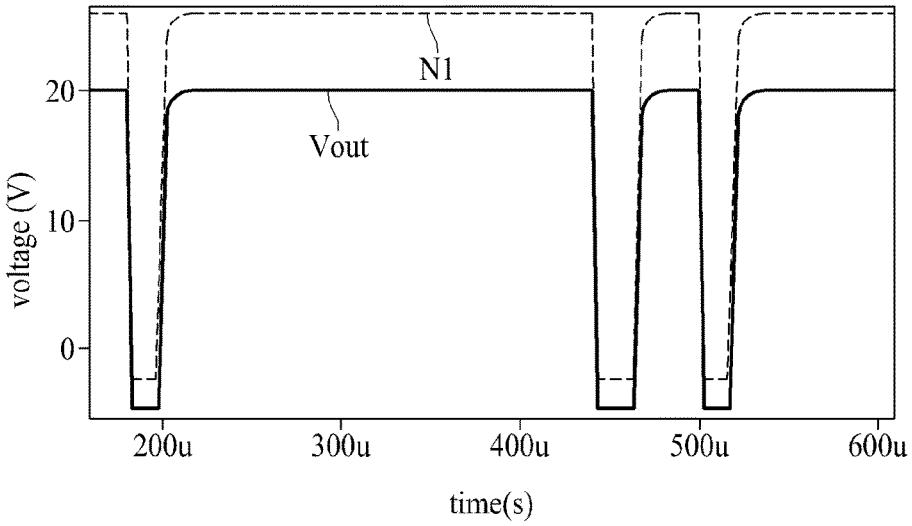

FIGS. 16A and 16B are simulation waveform diagrams showing an output waveform and a voltage of a control node of an emission control stage according to each of a comparative example and an embodiment of the present disclosure.

A waveform diagram of the comparative example shown in FIG. 16A shows a result of a simulation performed on an emission control stage having a general inverter structure (for example, the same structure as that of the second node voltage setting part illustrated in FIG. 6), and a waveform diagram of an embodiment of the present disclosure shown in FIG. 16B shows a result of a simulation performed on the emission control stage illustrated in FIG. 10B. Each of the simulation results a result of a simulation performed when a threshold voltage Vth of a transistor is −2 V, under a condition where eVdd is 20 V, eVH is 20 V, eVL is −5 V, eVss is −5 V, and each of Vin1 and Vin2 is −5 V to 5 V.

As shown in FIG. 16A, in the comparative example, it may be confirmed that a voltage of a control node Q is reduced by a leakage current of a turned-off transistor, and thus, an output voltage Vout is lowered.

On the other hand, as shown in FIG. 16B, in an embodiment of the present disclosure, it may be confirmed that since a transistor of a node reset part is completely turned off by a current leakage prevention part, the current leakage of a control node N1 is prevented, and thus, even when the transistor has a negative threshold voltage, a voltage of the control node N1 is stably maintained, whereby an output waveform Vout is stably output.

As described above, according to the embodiments of the present disclosure, the emission control shift register may output the emission control signal, based on the carry signal output from the scan control stage of the scan control shift register, and thus, a circuit configuration of the gate driving circuit is simplified and the emission control signal is stably output, thereby enhancing the reliability of driving and decreasing a bezel width of the light emitting display apparatus.

The above-described feature, structure, and effect of the present disclosure are included in at least one embodiment of the present disclosure, but are not limited to only one embodiment. Furthermore, the feature, structure, and effect described in at least one embodiment of the present disclosure may be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A gate driving circuit comprising:

an emission control shift register connected to a scan control shift register and receiving a first input signal and a second input signal from the scan control shift register, the emission control shift register including a plurality of emission control stages that each respectively supplies an emission control signal to one of a plurality of emission control lines, each emission control line connected to at least one pixel of a plurality of pixels in a light emitting display panel, wherein when at least one of the first input signal and the second input signal has a first voltage level, an emission control stage from the plurality of emission control stages that received at least one of the first input signal and the second input signal outputs the emission control signal having a gate-off voltage level to an emission control line connected to the emission control stage, the gate-off voltage level turning off a transistor included in a pixel connected to the emission control line, when both of the first input signal and the second input signal have a second voltage level that is less than the first voltage level, the emission control stage outputs the emission control signal having a gate-on voltage level to turn on the transistor included in the pixel connected to the emission control line, and wherein each of the plurality of emission control stages comprises:

a first control node, a second control node connected to a first input terminal receiving the first input signal from the scan control shift register, a third control node connected to a second input terminal receiving the second input signal from the scan control shift register, an output part outputting the emission control signal having the gate-on voltage level or outputting the emission control signal having the gate-off voltage level based on voltages of the first control node, the second control node, and the third control node, a node setting part setting a voltage of the first control node to a node driving voltage, and a node reset part resetting the voltage of the first control node to a node reset voltage, based on a voltage of the second control node and a voltage of the third control node.

2. The gate driving circuit of claim 1, wherein the gate-off voltage level comprises either a first gate-off voltage level or a second gate-off voltage level that has a different phase from a phase of the first gate-off voltage level, and wherein in response to the first input signal from the scan control shift register having the first voltage level, the emission control stage outputs the emission control signal having the first gate-off voltage level, in response to the second input signal from the scan control shift register having the first voltage level, the emission control stage outputs the emission control signal having the second gate-off voltage level, and the second input signal having the first voltage level is delayed for at least three horizontal periods from the first input signal having the first voltage level.

3. The gate driving circuit of claim 1, wherein the node reset part comprises:

a first reset circuit resetting the voltage of the first control node to the node reset voltage, based on the voltage of the second control node; and a second reset circuit resetting the voltage of the first control node to the node reset voltage, based on the voltage of the third control node.

4. The gate driving circuit of claim 3, wherein the first reset circuit comprises a first transistor and a second transistor connected in series between the first control node and a node reset voltage line through which the node reset voltage is supplied, a first connection node disposed between the first transistor and the second transistor, the second reset circuit comprises a third transistor and a fourth transistor connected in series between the first control node and the node reset voltage line, a second connection node electrically connected to the first connection node disposed between the third transistor and the fourth transistor, and the node reset part further comprises a current leakage prevention part supplying a current leakage prevention voltage to the first connection node, based on a control voltage.

5. The gate driving circuit of claim 4, wherein the current leakage prevention part comprises a fifth transistor that is turned on based on the control voltage to supply the current leakage prevention voltage to the first connection node disposed between the first transistor and the second transistor.

6. The gate driving circuit of claim 4, wherein the current leakage prevention voltage is the node driving voltage supplied by the node setting part or the emission control signal having the gate-on voltage level, and the control voltage is the voltage of the first control node or of the emission control signal of the output part.

7. The gate driving circuit of claim 4, wherein the output part comprises:

a pull-up transistor outputting the emission control signal having the gate-on voltage level based on the voltage of the first control node; and a pull-down transistor having a double gate structure and outputting the emission control signal having the gate-off voltage level, based on the voltage of the second control node and the voltage of the third control node.

8. The gate driving circuit of claim 3, wherein the first reset circuit comprises:

a first transistor turned on based on the voltage of the second control node to electrically connect the first control node to the node reset voltage line through which the node reset voltage is supplied; and a second transistor turned on based on the voltage of the third control node to electrically connect the first control node to the node reset voltage line through which the node reset voltage is supplied, the node reset voltage having a voltage level which is greater than each of the gate-off voltage level of the first input signal and the gate-off voltage level of the second input signal.

9. The gate driving circuit of claim 8, wherein the output part comprises:

a pull-up transistor outputting the emission control signal having the gate-on voltage level, based on the voltage of the first control node; and a pull-down transistor having a double gate structure and outputting the emission control signal having the gate-off voltage level lower than the gate-on voltage level, based on the voltage of the second control node and the voltage of the third control node.

10. The gate driving circuit of claim 1, wherein the node reset part comprises a reset circuit that resets the voltage of the first control node to the node reset voltage, based on the voltage of the second control node and the voltage of the third control node.

11. The gate driving circuit of claim 10, wherein the reset circuit comprises a first transistor and a second transistor connected in series between the first control node and a node reset voltage line through which the node reset voltage is supplied, a connection node being disposed between the first transistor and the second transistor, and the node reset part further comprises a current leakage prevention part charging the connection node with a current leakage prevention voltage, based on a control voltage.

12. The gate driving circuit of claim 11, wherein the first transistor comprises:

a bottom gate electrode connected to one of the second control node and the third control node;

a top gate electrode connected to another of the second control node and the third control node that is not connected to the bottom gate electrode;

a first electrode connected to the first control node, and a second electrode electrically connected to the connection node; and the second transistor comprises a bottom gate electrode connected to the bottom gate electrode of the first transistor, a top gate electrode connected to the top gate electrode of the second transistor, a first electrode connected to the node reset voltage line, and a second electrode connected to the connection node.

13. The gate driving circuit of claim 11, wherein the current leakage prevention part comprises a third transistor turned on based on the control voltage to supply the current leakage prevention voltage to the connection node.

14. The gate driving circuit of claim 13, wherein the current leakage prevention voltage is the node driving voltage supplied by the node setting part or the emission control signal having the gate-on voltage level, and the control voltage is the voltage of the first control node or of the emission control signal of the output part.

15. The gate driving circuit of claim 11, wherein the output part comprises:

a pull-up transistor outputting the emission control signal having the gate-on voltage level, based on the voltage of the first control node; and a pull-down transistor having a double gate structure and outputting the emission control signal having the gate-off voltage level lower than the gate-on voltage level, based on the voltage of the second control node and the voltage of the third control node.

16. The gate driving circuit of claim 1, wherein the node reset part comprises a first transistor having a double gate structure and outputting the voltage of the first control node as the node reset voltage, based on the voltage of the second control node and the voltage of the third control node.

17. The gate driving circuit of claim 16, wherein the first transistor comprises:

a bottom gate electrode connected to one of the second control node and the third control node;

a top gate electrode connected to another control node of the second control node and the third control node;

a first electrode electrically connected to a node reset voltage line through the node reset voltage is supplied; and a second electrode connected to the first control node.

18. The gate driving circuit of claim 16, wherein the output part comprises:

a pull-up transistor outputting the emission control signal having the gate-on voltage level, based on the voltage of the first control node; and a pull-down transistor having a double gate structure and outputting the emission control signal having the gate-off voltage level lower than the gate-on voltage level, based on the voltage of the second control node and the voltage of the third control node.

19. The gate driving circuit of claim 1, wherein the node setting part comprises a first transistor supplying the node driving voltage to the first control node in response to one of a direct current (DC) voltage, an emission clock, and the node driving voltage.

20. The gate driving circuit of claim 1, wherein the output part comprises:

a pull-up transistor outputting the emission control signal having the gate-on voltage level, based on the voltage of the first control node;

a first pull-down transistor outputting the emission control signal having the gate-off voltage level, based on the voltage of the second control node; and a second pull-down transistor outputting the emission control signal having the gate-off voltage level, based on the voltage of the third control node.

21. The gate driving circuit of claim 1, wherein the output part comprises:

a pull-up transistor outputting the emission control signal having the gate-on voltage level, based on the voltage of the first control node; and a pull-down transistor having a double gate structure and outputting the emission control signal having the gate-off voltage level lower than the gate-on voltage level, based on the voltage of the second control node and the voltage of the third control node.

22. The gate driving circuit of claim 21, wherein the pull-down transistor comprises:

a bottom gate electrode electrically connected to one of the second control node and the third control node;

a top gate electrode electrically connected to another control node of the second control node and the third control node;

a first electrode electrically connected to an output terminal through which the emission control signal is output; and a second electrode electrically connected to a low level voltage line through which the low level voltage is supplied.

23. The gate driving circuit of claim 1, wherein the scan control shift register includes a plurality of scan control stages respectively supplying a scan signal to a plurality of gate lines provided in the light emitting display panel, wherein the first input signal and the second input signals are carry signals output by the scan control shift register.

24. The gate driving circuit of claim 23, wherein the emission control stage is an $i^{th}$ (where i is one to m) emission control stage of the plurality of emission control stages and the first input signal input to the emission control stage is a carry signal output from a $j-a^{th}$ (where j is one to m, and a is a natural number) scan control stage of the plurality of scan control stages, wherein the second input signal input to the emission control stage is a carry signal output from a $j+b^{th}$ (where b is a natural number more than a) scan control stage of the plurality of scan control stages, and the $j^{th}$ scan control stage is disposed closest to the $i^{th}$ emission control stage.

* * * * *